US008515100B2

(12) United States Patent
Shajaan et al.

(10) Patent No.: US 8,515,100 B2
(45) Date of Patent: Aug. 20, 2013

(54) PROGRAMMABLE MICROPHONE

(71) Applicants: Mohammad Shajaan, Vaerlose (DK); Henrik Thomsen, Dyssegard (DK); Jens Jorge Gaarde Henriksen, Charlottenlund (DK); Claus Erdmann Fuerst, Roskilde (DK)

(72) Inventors: Mohammad Shajaan, Vaerlose (DK); Henrik Thomsen, Dyssegard (DK); Jens Jorge Gaarde Henriksen, Charlottenlund (DK); Claus Erdmann Fuerst, Roskilde (DK)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 13/752,602

(22) Filed: Jan. 29, 2013

(65) Prior Publication Data

US 2013/0170673 A1 Jul. 4, 2013

Related U.S. Application Data

(63) Continuation of application No. 13/434,575, filed on Mar. 29, 2012, which is a continuation of application No. 11/993,186, filed as application No. PCT/DK2006/000421 on Jul. 19, 2006, now Pat. No. 8,170,237.

(60) Provisional application No. 60/700,307, filed on Jul. 19, 2005.

(51) Int. Cl.
*H04R 3/00* (2006.01)

(52) U.S. Cl.
USPC ..... 381/113; 381/111; 381/112; 381/122

(58) Field of Classification Search
USPC ..... 381/111–113, 122
See application file for complete search history.

(56) References Cited

U.S. PATENT DOCUMENTS

| | | | |
|---|---|---|---|
| 5,051,799 | A | 9/1991 | Paul et al. |
| 5,555,287 | A | 9/1996 | Gulick et al. |
| 6,028,946 | A | 2/2000 | Jahne |

(Continued)

FOREIGN PATENT DOCUMENTS

| | | |
|---|---|---|
| EP | 0580341 | 1/1994 |
| FR | 2628590 | 9/1989 |

(Continued)

OTHER PUBLICATIONS

Written Opinion from PCT/DK06/00421, mailed on Feb. 5, 2007.

(Continued)

*Primary Examiner* — Luan C Thai
(74) *Attorney, Agent, or Firm* — Kenyon & Kenyon LLP

(57) ABSTRACT

A semiconductor die with an integrated electronic circuit, configured so as to be mounted in a housing with a capacitive transducer e.g. a microphone. A first circuit is configured to receive an input signal from the transducer at an input node and to provide an output signal at a pad of the semiconductor die. The integrated electronic circuit comprises an active switch device with a control input, coupled to a pad of the semiconductor die, to operatively engage or disengage a second circuit interconnected with the first circuit so as to operate the integrated electronic circuit in a mode selected by the control input. That is, a programmable or controllable transducer. The second circuit is interconnected with the first circuit so as to be separate from the input node. Thereby less noise is induced, a more precise control of the circuit is obtainable and more advanced control options are possible.

14 Claims, 20 Drawing Sheets

(56) References Cited

U.S. PATENT DOCUMENTS

| | | | | |
|---|---|---|---|---|
| 6,167,258 | A | 12/2000 | Schmidt et al. | |
| 6,853,733 | B1 | 2/2005 | Groothedde et al. | |
| 7,630,504 | B2 | 12/2009 | Poulsen | |
| 2003/0123682 | A1* | 7/2003 | Ito et al. | 381/113 |
| 2003/0235315 | A1* | 12/2003 | Reesor | 381/115 |
| 2004/0156520 | A1 | 8/2004 | Poulsen et al. | |
| 2005/0147255 | A1 | 7/2005 | Little | |
| 2005/0207596 | A1 | 9/2005 | Beretta et al. | |
| 2006/0147060 | A1* | 7/2006 | Shyu et al. | 381/113 |
| 2007/0160234 | A1* | 7/2007 | Deruginsky et al. | 381/113 |
| 2009/0316935 | A1* | 12/2009 | Furst et al. | 381/111 |

FOREIGN PATENT DOCUMENTS

| | | |
|---|---|---|
| GB | 2386280 | 9/2003 |
| JP | 10200466 | 7/1987 |
| WO | 01/78446 | 10/2001 |
| WO | 2004/034269 | 4/2004 |

OTHER PUBLICATIONS

PCT International Search Report from PCT/DK06100421, mailed on Feb. 5, 2007.

* cited by examiner

PROGRAMMABLE MICROPHONE

CROSS-REFERENCE TO RELATED APPLICATIONS

The present application is a continuation of and claims priority to U.S. patent application Ser. No. 13/434,575, filed Mar. 29, 2012; which is a continuation of U.S. patent application Ser. No. 11/993,186, filed Apr. 16, 2008; which is a U.S. national phase of International Application No. PCT/DK2006/000421, filed Jul. 19, 2006; which claims priority to U.S. Provisional Patent Application No. 60/700,307, filed Jul. 19, 2005. Each of the above applications is hereby incorporated by reference in its entirety.

BACKGROUND

The demand for microphones for mobile equipment such as mobile telephones, headsets and cameras tends to follow the growing demand for mobile equipment—for instance mobile telephones.

The demand has for many years been rather simple in that the demand was for microphones with extremely low costs and for microphones suitable for production in very high volumes. The performance of such microphones was comparable from one manufacturer to another and was at a level comparable to that of telephony systems. In recent years, however, the demand has changed to also be for microphones with a performance above that of telephony systems. Today there appears to be a trend in the demand heading towards so-called high-fidelity (hi-fi) quality.

Use of integrated digital processors, with ever increasing performance, in the different types of mobile equipment has also brought attention to the performance of the more peripheral links of the signal processing chain from pick-up of a signal over transmission and/or storage to reproduction of the signal. Such more peripheral link is for instance the microphone or the circuitry embodied with a microphone transducer in a microphone capsule. A microphone capsule—also denoted a microphone element—can include shock mounts, acoustic isolators, protective covers and a semiconductor die, with integrated circuitry, in addition to the microphone transducer. The microphone transducer and the integrated electronic circuit is embodied in the microphone capsule converts acoustic energy to electrical energy so as to provide an electrical microphone signal.

It has been discovered that integrated digital processors can be configured to repair some damages to a microphone signal occurred due to inadequate signal conditioning in the microphone capsule. But in general it is far more efficient not to disregard aspects of signal conditioning in peripheral links of the signal processing chain to thereby avoid destroying the microphone signal and consequently being able to provide far better repair of the signal if needed at all. The microphone signal may be destroyed by disregarding a noise source and/or by overloading an amplifier (in the capsule).

Thus, there is a demand for high quality microphones, but unfortunately the demand for low price seems to persist. As cost of a semiconductor die is directly related to the size of the die it is important, for the purpose of reducing price, that the electronic circuit integrated on the die is as small or compact as possible. Therefore, very simple circuits are desired, with a due regard to a desired (high) performance.

It has been discovered that meeting high performance demands is not simply a question of providing a more robust or conservative design. Due to the important cost issues and signal conditioning aspects it is found that there is no single one fixed signal conditioning circuit that is able to provide high performance in various acoustic situations. Such various situations could be described as a voice signal with/without loud/quiet background noise, a loud or quiet voice signal or combinations thereof. Thus, the signal conditioning needed to provide high performance is different from one situation to another.

It has therefore been proposed—despite the additional cost of a more complex semiconductor die in the capsule—to provide the semiconductor die with means for the circuit on the die to adapt to a given acoustic situation. Thereby, high performance can be achieved in different acoustic situations. In some designs of microphones it may be equitable to provide the adaptation to different acoustic situations by a control loop embodied entirely on the semiconductor die, but in other designs it may be equitable to provide the control loop to provide a control feedback from a circuit external to the microphone capsule. Thereby it is necessary to configure the semiconductor die for an external circuit to make the circuit in the semiconductor die adapt to a situation. To this end cost is generally an obstacle simply to have one or more additional pad(s) for receiving such an external feedback.

Thus, since high quality microphones are sought after, more complex circuitry is inherently needed which—all other things being equal—has a higher power consumption. Since the mobile equipment is battery powered current consumption of the device including portion thereof is subject to be minimized as far as possible. This adds an additional and important dimension to the demand.

The microphone is based on the principle of a capacitor, which is formed by a movable member that constitutes a membrane of the microphone and another member, e.g. a so-called back plate of the microphone. One of the members of the microphone, preferably the membrane, is charged by a constant electrical charge. The charge is either provided as an electrostatic charge captured on one of the members or provided by a voltage source e.g. a charge pump or voltage step-up circuit on the semiconductor die.

A sound pressure detected by the microphone will cause the membrane to move and consequently change the capacitance of the capacitor formed by the membrane member and the other member. When the charge on the capacitor formed by these two members is kept constant, the voltage across the two capacitor members will change with the incoming sound pressure level. As the charge on the microphone capacitor has to be kept constant to maintain proportionality between sound pressure and voltage across the capacitor members, it is important not to load the microphone capacitance with any resistive load. A resistive load will discharge the capacitor and thereby degrade or ruin the capacitors performance as a microphone. A capacitive load will reduce sensitivity of the microphone transducer.

Therefore, in order to pick up a microphone signal from the capacitor, amplifiers configured with the primary objective of providing high input resistance are preferred to buffer the capacitor from circuits which are optimized for other objectives. The amplifier connected to pick up the microphone signal is typically denoted a preamplifier or a buffer amplifier or simply a buffer. The preamplifier is typically connected physically very close to the capacitor—within a distance of very few millimeters or fractions of millimeters.

For small sized microphones only a very limited amount of electrical charge can be stored on one of the microphone members. This further emphasizes the requirement of high input resistance. Consequently, the input resistance of preamplifiers for small sized microphones has to be extremely high—in the magnitude of Giga ohms. Additionally, the input capacitance of this amplifier has to be very small in order to achieve a fair sensitivity to sound pressure.

Traditionally, this preamplifier has been implemented as a simple JFET. The JFET solution has been sufficient, but demands in the telecom industry call for ever smaller microphones—with increased sensitivity. This yields a contradiction in terms since sensitivity of the microphone capacitor drops as size goes down. All other things being equal, this will further reduce the sensitivity of the microphone and the buffer in combination. The demands in the telecom industry are among other things driven by market trends which encompass hands free operation of different types of small-sized equipment and more widespread application of microphones in e.g. camera applications.

So obviously, there is a need for microphone preamplifiers with gain and very low input capacitance, and lowest possible preamplifier die area. Additionally, low noise is important. Low noise is important as noise, during design of the microphone, can be traded for area—i.e. if the circuit has low noise and a noise lower than required, this noise level overhead can be traded for lower chip die area and it is thus possible to manufacture the preamplifier at lower cost.

When designing a preamplifier for a microphone there is normally three noise sources. These sources are noise from a bias resistor, 1/f noise from an input transistor, and white noise from the input transistor. Typically, input transistor noise dominates. Both white noise and 1/f noise can be minimized by optimizing the length and the width of the input transistor(s). This applies for any input stage e.g. a single transistor stage or a differential stage.

The noise from the bias resistor can also be minimized. If the bias resistor is made very large then the noise from the resistor will be high pass filtered and the in-band noise will be very low. This has the effect though that the lower bandwidth limit of the amplifier will be very low. This can be a problem as the input of the amplifier will settle at a nominal value only after a very long period of time after power up. Additionally, signals with intensive low frequency content arising form e.g. slamming of a door or infra sound in a car can overload the amplifier. Another related problem is small leakage currents originating from mounting of the die inside a microphone module. Such currents will, due to the extreme input impedance, establish a DC offset. This will reduce the overload margin of the amplifier.

Microphones is typically manufactured with a yield of approximately 80-90% i.e. 80-90% of the total number of produced microphones satisfy specifications on their performance. Unfortunately, 10-20% of the production is discarded since for instance sensitivity of the microphone does not satisfy the specification. A solution to reducing the discarding rate would be highly appreciated by the industry.

Another problem of e.g. electret microphones is the ageing phenomena's in which the electret microphone might change sensitivity over time thereby leading to a discrepancy between the electret microphone output and the gain of the buffer amplifier.

A microphone subjected to a background noise comprising low frequency sound at high amplitudes, e.g. from a motorized vehicle, may be prone to the problem of e.g. clipping the sound signal from the microphone. In case a voice signal is present in combination with such a background signal, the information in the voice signal may be lost since the sound pressure results in the corresponding electrical signal being clipped. The clipping of the microphone signal may occur when the amplitude of the low frequency background superposed on the voice signal overload the amplifier amplifying the signal from the microphone e.g. by exceeding a maximum sound pressure that the microphone and amplifier may handle e.g. 110 dB SPL. Minor overloading of the amplifier may result in signal clipping while severe overloading of the amplifier may yield a period of time, e.g. in the order of seconds, where the amplifier has ceased to operate as an amplifier.

PRIOR ART

U.S. Pat. No. 6,853,733-B1 discloses a two-wire interface for a digital microphone circuit, which includes a power line and a ground line. The interface utilizes the ground line as a "voltage active line" to transmit both clock and data signals between the digital microphone circuit and a receiving circuit. The digital microphone circuit detects the clock signal on the voltage active line and uses the detected clock signal to operate an ADC to provide digital data. The digital data is used to selectively drive current back to the receiving circuit over the voltage active line. The receiving circuit detects the transmitted data by monitoring the voltage associated with a line termination. The impedance associated with the line termination is switched by the receiver circuit to modulate the clock signal on the voltage active line.

Thus, the digital microphone circuit detects the clock signal on the voltage active line and uses the detected clock signal to output digital bits at time instances determined by the clock signal. This principle is commonly known for retrieving a digital signal synchronized to the clock signal of an external circuit consuming the digital signal.

WO 01/78446 discloses a variable sensitivity/variable gain circuit for an electret microphone assembly comprising an amplifier and a transducer for use e.g. in a hearing aid. The circuit comprises a sensitivity selecting portion with an electronic switch coupled in series with a capacitor. The electronic switch is controlled by a voltage on a control terminal. Thereby the sensitivity of the microphone can be decreased when the capacitor is coupled in and otherwise the signal from the transducer is left unaltered by the circuit. The sensitivity selecting portion is coupled directly to the transducer so as to control the sensitivity. In an embodiment the sensitivity selecting portion is coupled as a negative feed-back with respect to the amplifier so as to change its gain. The sensitivity setting of the circuit is programmable and may be programmed or stored in a non-volatile memory component which is operatively coupled to the circuit through a decoder. The decoder can have n parallel inputs or one serial input signal. Thus, it is possible to program the circuit to change the sensitivity of the microphone assembly.

Thus, there exist prior art microphones where signal conditioning of the circuit on the semiconductor die embodied in the capsule can be adapted to different acoustic situations. This is expedient since this adaptation or compensation is located as peripherally as possible—directly with the source i.e. the microphone transducer.

However, the disclosed solutions have introduced at least one additional and unfortunate noise source which is disregarded. This may appear to be a small drawback in the light of providing adaptation to different acoustic situations, but this unfortunate source will contribute to non-repairable imperfections in the microphone signal, making it more difficult to arrive at a high performance microphone.

Further, since the sensitivity selecting portion is coupled directly to the transducer at the input node of the circuit, the sensitivity is determined by the ratio between the effective value of the capacity of the transducer including any parasitic capacities and the value of the capacity of the sensitivity selecting portion. This is inappropriate in that the sensitivity is thus determined by a capacitor on the semiconductor die and a capacitor external to the semiconductor die. The value of the external capacity is subject to large variations in manufacture. This makes it almost impossible to obtain a desired value of sensitivity precisely—at least with reasonable yield values.

SUMMARY

There is provided a semiconductor die with an integrated electronic circuit, configured so as to be mounted in a housing with a capacitive transducer. The electronic circuit comprises a first circuit configured to receive an input signal from the transducer at an input node and to provide an output signal at a pad of the semiconductor die; where the integrated electronic circuit comprises an active device with a control input, coupled to a pad of the semiconductor die, to operatively engage or disengage a second circuit interconnected with the first circuit so as to operate the integrated electronic circuit in a mode selected by the control input.

The semiconductor die is characterized in that the second circuit is interconnected with the first circuit so as to be separate from the input node.

Thus, the second circuit is interconnected with the first circuit, but at one or more nodes separate from the input node.

The signal transfer from the transducer to the output can then be determined more precisely since the signal transfer then is independent of variations in the impedance of the capacitive transducer. This is equitable since in practice large variations do occur e.g. due to uncontrollable parasitic capacitances at the input node caused by the transducer capsulation. When signal transfer is controlled by the ratio of the impedances of two units, the signal transfer is less sensitive to variations in the impedances. Consequently, a more precise signal transfer can be provided.

Since the second circuit is interconnected with the first circuit, but at one or more nodes separate from the input node, the signal transfer will be less sensitive to noise induced by the active device operating as a switch.

Moreover, since the second circuit is interconnected with the first circuit, but at one or more nodes separate from the input node, different signal transfer modes can be implemented to include selection of not only different capacitors, but also different resistors or circuit networks of resistors and capacitors. Thereby different signal transfer modes implementing different filters can be implemented. This provides a great improvement in terms of performance in that it is for instance far more equitable to select a high-pass filter (with a higher cut-off frequency) to prevent undesired signal components at low-frequency and with strong amplitudes from overloading, e.g. an amplifier, in the first circuit compared to simply selecting a lower sensitivity. Selecting a filter instead of simply lowering sensitivity makes it possible to diminish only those signal components that are undesired e.g. infrasound signals, but not desired signal components e.g. important components of voice signals.

It is generally desired to provide relatively simple and compact circuits with relatively high precision in order to meet performance specifications at relatively low cost. This is achieved when the input node is coupled to the output at least via a signal conditioning circuit; the signal conditioning circuit comprises a first unit with a first parameter and a second unit with a second parameter controllable by the second circuit and the active device; the parameters of the first and second units in combination operatively determine a property of the signal conditioning circuit; and where both units are embodied on the semiconductor die. Thereby the transducer can be disregarded as a source contributing to undesired variations affecting signal transfer.

The first and second units can be considered to be a two-port network of components or a single component. The parameters can then e.g. be the impedance between the ports of the two-port circuit. The property of the signal conditioning circuit can then be a property of the signal transfer from the input node to the output e.g. gain, cut-off frequency etc. The parameters can alternatively or additionally be e.g. the width of the semiconductor material of an active device or multiple active devices. The property of the signal conditioning circuit can then be e.g. power consumption which is typically related to noise and/or DC values at a circuit node.

The second parameter (and consequently the property of the signal conditioning circuit) is controllable by the second circuit in that the second circuit or a portion thereof is engaged or disengaged. Thereby, one or more of different components such as capacitors, resistors and active devices can be switched in and out. If for instance an active device is coupled in to operative work in combination with another active device of the second unit, the width of the semiconductor material of the active devices in combination is increased. Thereby, a property of the signal conditioning circuit can be changed.

In an embodiment the input node is connected to the input of a signal conditioning circuit that provides the output signal; the second circuit is coupled to operatively alter the configuration of the signal conditioning circuit in response to a signal on the control input; and the input node is separated from the signal conditioning circuit by the signal conditioning circuit being operatively coupled to the input node only by means of a gain stage. The gain stage can be a single gain stage or be a portion of an amplifier comprising multiple gain stages.

An amplifier comprising multiple gain stages can be an amplifier with a differential input stage. In an embodiment, the integrated electronic circuit comprises a differential gain stage with a first and a second input terminal, where the first input terminal is coupled to the input node so as to receive a signal from the transducer, and where the second input terminal is coupled to the second circuit so as to receive a signal which is controlled by the active device; and where the signal from the transducer and the signal which is controlled by the active device are coupled separately to respective ones of the first input and the second input.

Thus, the input node and a node of the second circuit are coupled at different paths of the differential input stage. Since the impedance between input of a differential input stage is very high, often regarded as being infinitely high, the second circuit imposes virtually no loading of the input node. Consequently, an improved input impedance is obtained which efficiently reduces signal loss from the transducer improving the sensitivity of the transducer and electronic circuit—all other things being equal.

In an embodiment the differential gain stage is coupled to an output stage with an output terminal via a feedback circuit to provide a feedback signal; and the second circuit is coupled so as to operatively change the feedback circuit in response to the control signal.

Thereby, since the transducer signal input to the gain stage (or entire amplifier) is not loaded by the feedback circuit, it is not exposed to an only slowly decaying impulse response of the feedback circuit. To prevent the amplifier from overloading (clipping output signal) when the transducer is exposed to acoustical signals or movements (vibrations) with heavy undesired low-frequency signal components, the feedback circuit can be implemented as a low-pass filter so as to provide high-pass filter transfer of the amplifier. Thus, since the transducer signal input to the gain stage is not exposed to the only slowly decaying impulse response of the feedback circuit (which may be a low-pass filter) and since infrasound signal components with excessive amplitudes are effectively suppressed, such infrasound signal components (and DC like components) are effectively prevented from overloading the preamplifier (which would otherwise cause serious distortion). It would in general not be possible to repair a signal in a downstream signal processor since important information in the signal would be lost.

In an embodiment the second circuit is configured and interconnected with the first circuit to provide a first signal transfer function, from input to output of the first circuit, when the second circuit is disengaged and to provide a second signal transfer function, different from the first, when the second circuit is engaged.

Consequently, the signal transfer function can be adjusted from the control signal. Thereby signal conditioning of the first circuit can be selected in response to the control signal provided by an external source. The external source can be in a better position to judge which signal conditioning is desired to meet a desired performance. The signal conditioning can comprise different gain settings, different gain-frequency functions, different phase-frequency functions or combinations thereof. Thereby for instance in a microphone a so-called whisper mode can be selected. In the whisper-mode, the signal transfer function enhances a frequency band, where important signal components of voice signals are located and suppresses a signal band (e.g. at lower frequencies) where dominating background signals are located.

In an embodiment the integrated electronic circuit is configured with a differential output stage so as to provide a common-mode differential output signal in a stop band and a differential-mode differential output signal in a pass band.

Due to the differential output which can be provided in common-mode for low frequencies and in differential mode for higher frequencies, infrasound signal components with excessive amplitudes are effectively suppressed. Thus, since the microphone signal input to the preamplifier is not exposed to the only slowly decaying time constants of the feedback circuit and since infrasound signal components with excessive amplitudes are effectively suppressed, such infrasound signal components (and DC like components) are effectively prevented from reaching further downstream signal conditioning circuits, such as an analogue-to-digital converter, wherein they otherwise would be a source to serious distortion (in the digital domain). Further, since the output (to the analogue-to-digital converter) is provided as a differential signal, it is possible to establish a greater signal swing. This in turn provides for configuring the preamplifier with a larger gain and improves the signal-to-noise ratio (in the digital domain since, generally, the analogue-to-digital converter gives rise to an amplitude independent noise contribution).

In an embodiment the input node is coupled to the output of a filter so as to receive a filtered signal from a charge pump circuit of the first circuit; and where the second circuit is interconnected with the first circuit at a circuit node of the charge pump circuit.

Thus the input node is separated from any nodes of the second circuit at least by means of the filter. The input node may be additionally coupled to the input of an active gain device.

It is generally desired to control sensitivity of a microphone or other capacitive transducer. In an embodiment the semiconductor die comprises a charge pump with a cascade of charge pump stages; where the second circuit comprises a portion of the cascade to engage or disengage the portion so as to control the output voltage from the charge pump.

Consequently, sensitivity can be changed. This is expedient for instance to reduce sensitivity when a signal from the transducer would otherwise be clipped at the input of an amplifier.

In an embodiment an input to the cascade is provided by a reference circuit; and where the second circuit is interfaced with the reference circuit so as to control the output voltage from the charge pump. Thereby the output voltage from charge pump is controlled by selecting different reference levels for the charge pump.

It is generally desired to be able to control power consumption of the semiconductor die. In an embodiment the second circuit comprises a first current source which is configured and interconnected with the first circuit which comprises a second current source to provide a first current consumption, of the integrated electronic circuit, when the second circuit is disengaged and to provide a second current consumption, different from the first, when the second circuit is engaged.

Thereby a relaxed performance mode and a nominal performance mode can be implemented. Alternatively, a nominal performance mode and an improved performance mode can be implemented. A relaxed performance mode can e.g. be implemented in a wireless headset for a mobile phone, computer or the like. In the relaxed performance mode the signal conditioning of the electronic circuit has not ceased to work, but in general since the circuit is operated at a lower current consumption more noise will be present. The relaxed mode can be used to listen to the acoustical environment to detect an acoustic event which should be used to change mode or as an alternative to power-off the circuit which would cause longer start-up time. More than one or two modes can be provided to e.g. implement the three different modes mentioned. One of the modes can be a so-called sleep mode where a shorter start-up time is provided compared to a power-on situation. In the sleep mode the transducer does not necessarily operate as a transducer, but in the relaxed performance mode the transducer can continue to operate as a transducer, but at a lower performance level while conserving power consumption.

The modes can be selected in response to detection of a clock frequency range of a clock signal input to the semiconductor die to thereby provide a very simple interface for controlling power consumption.

It may be desired to provide programming or mode control of a circuit to change or tune performance of a circuit during manufacture. The semiconductor die can comprise an element configured to receive a programming signal which changes the physical state of the element to form a non-volatile memory; where the element is coupled to the control input of the active device to operatively select a mode of the integrated electronic circuit.

Thereby a mode can be selected by so-called one-time-programming where the physical change of state provides a non-volatile memory. The circuit can comprise an array of elements that are addressable and configured to individually receive a programming signal which changes the physical state of the elements to form a non-volatile memory; where the elements are coupled to control inputs of respective active devices to operatively select a mode of the integrated electronic circuit. Thereby one of multiple modes can be selected.

In order to categorize or determine which mode to select (e.g. during manufacturing) it can be desirable to provide measurements of signal levels on the semiconductor die. However, with only very few pads to access only very few nodes of the circuit, only inequitable measuring may be performed. In an embodiment the active device and the second circuit is configured as a shunt circuit to pass a circuit node of the first circuit on to a pad of the semiconductor die.

Thereby one or more nodes of the circuit on the die can be connected to an available pad while shunting or disengaging a circuit otherwise interfaced via the pad. Consequently a test mode or measurement mode is provided. Such a mode is selected via the control input. The circuit can be configured to sequentially pass a node from a set of nodes on to the pad. Thereby different nodes can be coupled to the pad so as to perform measurements of signal levels at the respective node. The latter can be performed by means of a test mode sequencer which in response to a control signal couples a circuit node selected by the programming signal to a terminal of the integrated circuit chip for use by an external circuit. In an embodiment, the pad serves to output signals at nodes of the circuit in a first mode and serves to receive a signal for selecting the a mode (e.g. the first mode) in a second mode.

In general it is noted that selecting a different mode than desired could severely degrade the performance of the electronic circuit. In an embodiment, the semiconductor die comprises a mode controller configured to receive programming instructions carried by a programming signal and to provide the control signal to the active device; and a mode detector which is configured to receive a mode select signal and to enable or disable the mode controller in response to the mode select signal. Thereby the likelihood that a fake programming signal is received and used to select mode is reduced so as to avoid unintended or faulty selection of a wrong mode. When only a limited number of pads are available and the programming signal is received via a pad that serves to interface another signal (e.g. an output signal) when the circuit is in a normal mode of operation (when mode controller is disabled), the enable signal can serve to alter which circuits that are operatively using the pad.

In an embodiment the semiconductor die comprises a pad to receive a clock signal which is input to the semiconductor die; and a mode detector which is configured to detect within which of predefined ranges the frequency of the clock frequency is, and to engage or disengage the second circuit in response to the mode select signal. Thereby the frequency of a clock signal to an analogue-to-digital converter on the semiconductor die is used to select a mode. This makes it simple for an external circuit to interface with circuit. Such a selected mode can be a mode where power is conserved. It is well-known that reduction of the frequency of the clock can reduce power consumption—all other things being equal. But, when the power consumption is actively controlled to be lower (e.g. by disengaging current sources in a parallel configuration of multiple current sources) a far lower power consumption is reachable e.g. to provide a relaxed performance mode.

It is generally desired to have as few pads as possible since they occupy area on the semiconductor die and (thus) adds cost. In an embodiment the semiconductor die comprises a pad at which the integrated electronic circuit is configured to receive operating power and/or to provide the output signal and configured to receive a mode select signal and/or a programming signal.

Thereby pads with multiple functions are provided. The active device is coupled so as to operate in response to an external signal such as the mode select signal and/or programming signal.

In an embodiment the semiconductor die comprises a first pad at which a mode select signal is received and a second pad at which a programming signal is received. Thereby less circuitry is required while the likelihood that a fake programming signal is received and used to select a wrong mode is reduced.

In an embodiment the semiconductor die is configured to: detect a programming signal which comprises a preamble with a pulse rate which is an integer fraction, larger than one, of a nominal rate of a clock signal provided to the integrated circuit, and in response to a detection of a programming signal, enter a mode where programming instructions are received and registered.

In an embodiment the semiconductor die is configured to detect a preamble signal as a precondition for performing the step of detecting a programming instruction.

There is also provided a microphone housing comprising a semiconductor die according as set forth above; a mobile phone comprising a semiconductor die as set forth above; and a headset comprising a semiconductor die as set forth above.

BRIEF DESCRIPTION OF THE DRAWING

In connection with the detailed description reference will be made to the drawing in which.

DETAILED DESCRIPTION

Figure 1:
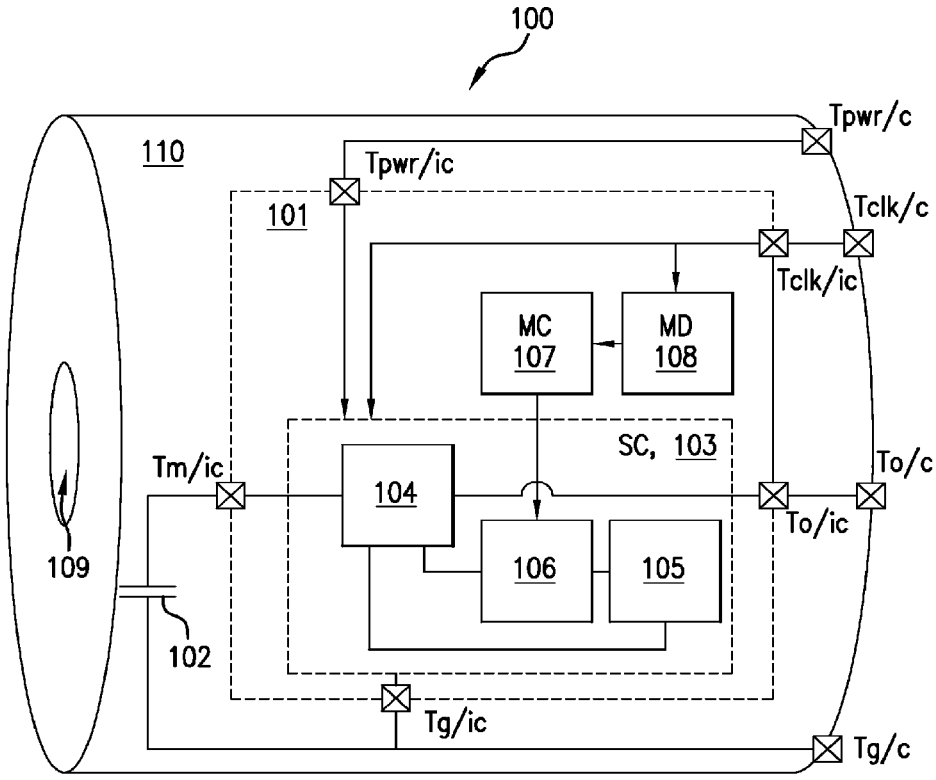
FIG. 1 shows a microphone configured to be operated in a selectable mode.

FIG. 1 shows a microphone configured to be operated in a selectable mode. The microphone 100 comprises a capsule or housing 110 that accommodates a capacitor microphone 102 and an semiconductor die 101 and connector terminals Tpwr/c, Tclk/c, To/c and Tg/c. The capacitor microphone 102 has a membrane member that moves relative to a second member (e.g. a so-called back plate) in response to a sound pressure on the membrane. The housing comprises an opening 109 for passage of sound. The capacitor microphone is coupled to the semiconductor die via terminals on the IC. The terminals are designated Tm/ic and Tg/ic, where the slash 'ic' designates that the terminals are located on the semiconductor substrate or integrated circuit, IC. Via the terminal Tm/ic a microphone capacitor signal provided by movements of the membrane is input to the IC. The second member is coupled to a ground reference which is coupled to the IC via terminal Tg/ic and to an external circuit via the terminal Tg/c of the microphone capsule—the slash 'c' designates that the terminal is a portion of the microphone capsule or housing.

The microphone capacitor signal is provided to a signal conditioner 103 which provides a microphone output signal via a terminal To/ic of the IC and via terminal To/c of the microphone capsule. The signal conditioner 103 has different objectives, but two primary objectives are to provide an output signal which is responsive to the sound pressure on the capacitor microphone and to buffer the high-impedance capacitor microphone, 102, such that the capacitor microphone is not loaded by the input impedance of an external circuit and such that the signal path between the capacitor microphone and the signal conditioner 103 is as short as possible to reduce the amount of noise picked up by this high-impedance path.

However, since the signal conditioner 103 is far more advanced than the well-known Junction Field Effect Transistor which has been a de facto industry standard for years and since performance of the capacitor microphone can be further improved by programming by an external circuit, a further objective is to provide a programmable signal conditioner 103 configured as an integrated circuit mounted in a microphone capsule. It should be noted that power is supplied to the signal conditioner 103 via terminals Tpwr/ic and Tpwr/c.

The signal conditioner comprises a first circuit 104 configured to receive an input signal from the transducer at an input node Tm/ic and to provide an output signal at a pad To/ic of the semiconductor die 101. An active device 106 coupled is as a switch with a control input to be provided from the mode changer. The control input is coupled to a pad of the semiconductor die via a mode changer and a mode detector, to operatively engage or disengage a second circuit 105 interconnected with the first circuit 104 so as to operate the integrated electronic circuit in a mode selected by the control input at the terminal Tclk/ic. It should be noted that other of the pads can be used to input a control signal—this will be described in greater detail. Since the second circuit is interconnected with the first circuit so as to be separate from the input node, the signal at the input node is not disturbed.

In a first aspect the signal conditioner 103 is programmed by means of a mode detector 108 and a mode changer 107. The mode detector 108 is coupled to receive a programming signal provided by an external circuit. The programming signal is provided via a separate terminal or, as it probably would be demanded, via a terminal that also serves to supply another signal from the external circuit to the IC or vice versa. Thus, it is preferred to provide the programming signal by multiplexing with such another signal.

The shown embodiment is configured to receive the programming signal on the same line as the clock signal provided via terminals Tclk/ic and Tclk/c of the IC and the microphone capsule, respectively. Thus, the programming signal is multiplexed with the clock signal.

As it is shown, the mode detector 108 is coupled to receive a clock signal provided by an external circuit. In case the microphone is configured to provide a digital output signal, the clock signal is typically provided by the external circuit to read out the digital signal synchronously. Hence, it will not require further terminals to communicate the programming signal.

The mode detector 108 is configured to de-multiplex the programming signal and to convert the programming signal to a control signal, which selectively controls the mode changer 107 to change the signal processing behaviour of the signal conditioner 103.

The combination of the mode detector, mode changer 107 and the signal conditioner 103 is expedient for providing simple programmable performance of the microphone.

The combination is especially expedient for programming performance which requires very few and short commands. Such performance is for instance related to programming of power consumption performance. In connection with power consumption it is possible to by programming to bring the signal conditioner 103 into a state or mode intermediate to a mode wherein it is shut-off and a mode wherein it is operated at a nominal power level. This will be described further in the below.

The mode changer 107 can be implemented in different ways. Generally, it is preferred to integrate the mode changer 107 closely with the signal conditioner 103 e.g. by means of a network of components which can be switched in and out of a network circuit configuration to thereby provide a circuit unit with discrete selectable values. For instance power supply to the signal conditioner 103 can be routed via the mode changer 107 to set different power consumption levels for the signal conditioner 103. This will also be described further in the below.

As an alternative to extract the programming signal from the clock signal, it is an option to provide the programming signal via the power signal (via Tpwr/ic) and to extract the programming signal from the power signal. Moreover, an alternative is to provide the programming signal via one, two or more separate terminals (not shown). These alternatives are expedient in case an analogue signal is provided as the output signal and thus that a clock signal typically is not available.

The mode detector 108 can provide for programming of the signal conditioner 103 performance in terms of power consumption or in terms of actively programming different signal processing parameters such as gain, lower and upper cut-off frequencies etc. Moreover, in case a bias voltage is supplied to the capacitor microphone the voltage bias level can be programmed by means of the mode detector. The aspect of providing a voltage bias level to the capacitor microphone is described in more detail in co-pending application WO2005/055406. With reference to this application the mode detector 108 can program the voltage pumping level, the number of pumping stages, the clock signal to the pump stages etc. By adjustment of the voltage bias level (applicable for a microphone with external biasing—and without an electret layer) provided to the microphone the performance e.g. the sensitivity of the microphone can be controlled.

Figure 2:
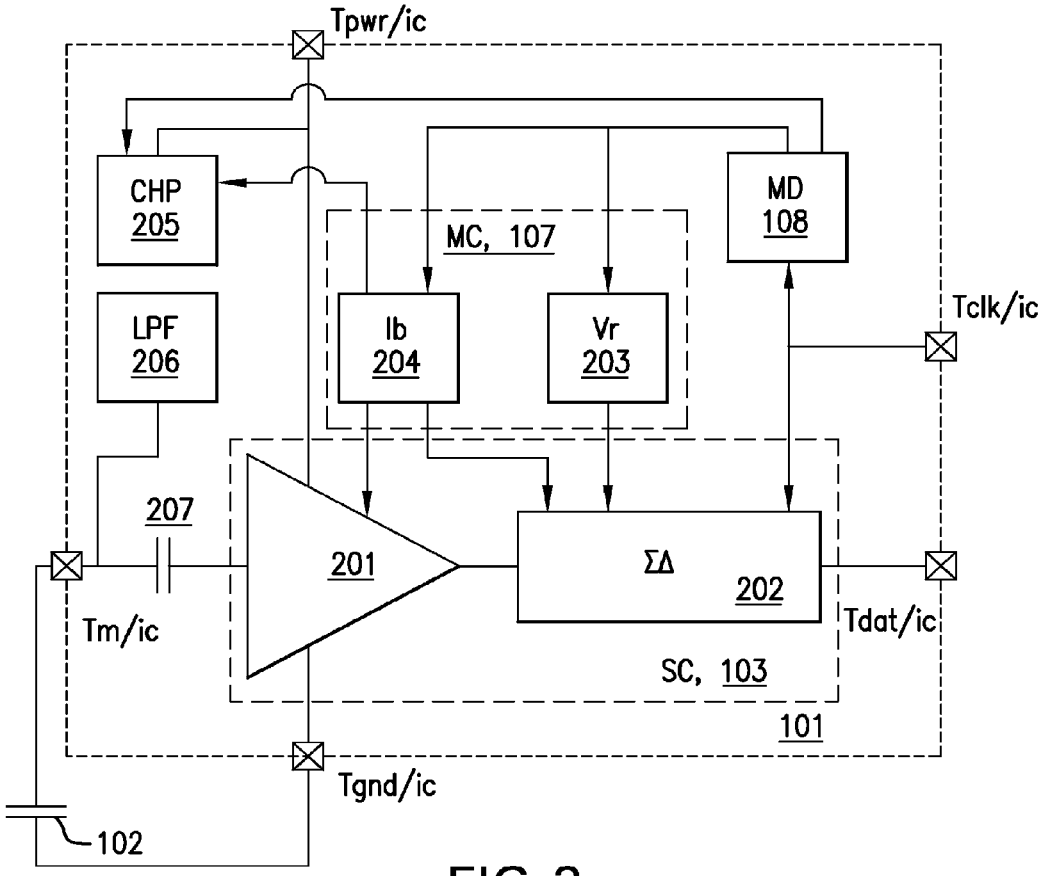
FIG. 2 shows a transducer and a semiconductor die, with a circuit to be operated in a selectable mode, comprising an amplifier, a charge pump and an analogue-to-digital converter.

FIG. 2 shows a transducer and a semiconductor die, with a circuit to be operated in a selectable mode, comprising an amplifier, a charge pump and an analogue-to-digital converter. The transducer comprises an integrated circuit with a signal conditioner 103, a mode detector 108 and a mode changer 107. The signal conditioner 103 comprises an amplifier 201 followed be an analogue-to-digital converter in the form of a Sigma-delta modulator 202 which provides a digital output signal of the microphone. For simplicity, the transducer housing is not shown. The amplifier 201 is characterized by high input impedance compared to the capacitance of the capacitor microphone, 102. The amplifier 201 can be a simple buffer or gain stage optionally in combination with a filter stage or it can comprise a low-pass or band-pass filter integrated with the amplifier as disclosed in co-pending application WO2005/039041.

Reverting to programming of power consumption performance, the shown embodiment is configured to enable an external circuit to program or determine the power consumption level in response to a programming signal. As described above, the programming signal is multiplexed with the clock signal. Thus, the purpose of the mode detector 108 is to select a performance mode of the microphone in response to the programming signal.

Typically, it is desired to operate the transducer at a nominal power consumption level in order to obtain the performance of the microphone in normal operation. With reference to the power consumption under normal operation it is desired to provide a so-called sleep-mode wherein the power consumption is lowered substantially, but wherein the power is not completely turned off. Such a sleep-mode is expedient since power-consumption is substantially reduced while protracted start-up times of the circuitry is avoided or at least reduced. In such a sleep-mode signal processing of the transducer signal to provide the output signal is almost completely shut-off or the signal processing performance is dramatically reduced. However, in the sleep-mode or a mode intermediate to the normal operation and the sleep-mode a certain but reduced level of signal processing performance can be maintained. Such modes providing a reduced but not shut-off power consumption are denoted relaxed performance modes since performance inevitable is reduced when the power consumption is reduced.

In a preferred embodiment the programming signal is provided as a clock signal with reduced rate compared to the clock signal input to the IC when it operates in a normal operation mode. The fraction the clock signal is reduced compared to a nominal rate controls which relaxed performance mode the mode detector 108 is to select. Thus, the relaxed performance mode can be detected via the clock input signal. Consider for instance an example where the microphone in its normal operation mode is provided with a clock signal with a nominal clock rate of 2.4 MHz, then the mode detector 108 can select modes as defines below:

1. when the clock is below 100 kHz sleep mode is selected,
2. when the clock is between 100 kHz and 1 MHz relaxed mode 1 is selected,
3. when between 1 MHz and 2 MHz relaxed mode 2 is selected, and
4. when above 2 MHz full performance mode is selected.

It should be noted that when the digital output signal is provided as a Pulse Density Signal at an over-sampled rate, a fixed decimation rate in the external circuit which provides digital post-filtering will result in a reduced bandwidth of the microphone signal. The bandwidth is lowered gradually with decreasing clock frequency. This is basically an undesired effect since the power consumption is not (substantially) reduced.

However, the mode detector 108 provides a control signal which is adapted to control the analogue circuits of the digital microphone to thereby reduce the power consumption. Control of the analogue circuits is accomplished by the mode changer 107, which in the shown embodiment is implemented as a voltage bias circuit, Vbias, and a voltage reference circuit, Vref. The mode changer 107 determines the power consumption of the analogue circuits in response to the control signal from the mode detector. The analogue circuits count the preamplifier, a voltage pump and integrators of the sigma delta modulator 202. The power consumption of the amplifier 201 is controlled via Vr, 203 and the power consumption of the Sigma-delta modulator is controlled via Vbr and Ib 204. Using less current means a higher noise level and thus a relaxed performance of the microphone.

By reducing only the clock rate, the bandwidth off the modulator is decreased and the dynamic power consumption is reduced. However, in order to obtain a substantial reduction of the current consumption, the static current consumption in the analogue circuits has to be reduced. Thus, since the static current consumption is accountable for the waste majority of the current consumption in the digital (or analogue) microphone it is feasible to control the static current consumption. The static current consumption is controlled by adjusting the biasing to the e.g. the preamplifier and the Sigma delta modulator.

Please note that the sigma delta modulator normally consist of up to 4, 5, 6, 7 or even more integrators, where each integrator has to be biased with an optimal current. In the same way it is possible to control the reference voltage generator to the modulator.

The semiconductor die further comprises a charge pump 205 to supply a charge to one of the members of the capacitive transducer 102—the charge pump 205 provides a DC signal as its output. The output of the charge pump is provided to the transducer only via a filter 206—e.g. a low-pass filter configured to diminish ripple noise from the output signal from the charge pump. As will be described in greater detail, the charge pump can be operated from a controllable current source Ib, 204 or be control of an internal current source or reference embodied with the charge pump. This internal source or reference can be controlled from the mode detector 108 or a mode changer (not shown).

Figure 3:
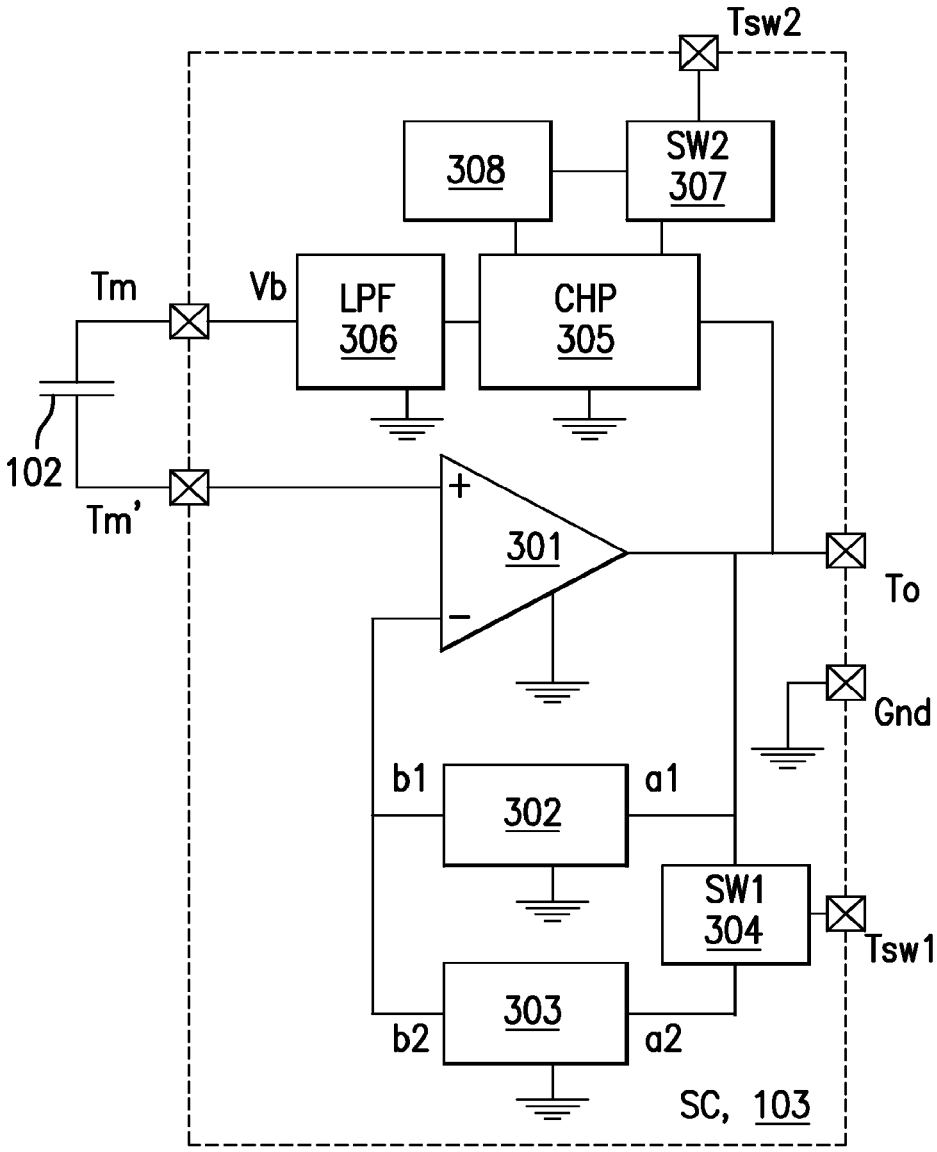
FIG. 3 shows a transducer and a semiconductor die with a controllable amplifier and a controllable charge pump.

FIG. 3 shows a transducer and a semiconductor die with a controllable amplifier and a controllable charge pump. The controllable amplifier is configured to be controllable with respect to its signal transfer function from its input Tm' (or non-inverting input: +) to its output To. The controllable amplifier comprises an operational amplifier 301 configured with a controllable feedback circuit 302, 303, 304. The controllable feedback is coupled from the output, To, to the inverting input of the operational amplifier 301. The controllable feedback comprises a first path (from node a1 to node b1) which can be in the form of any circuit network 302 operational as a feedback. It also comprises a second path (from node a1 via node a2 to node b). A first portion (a2 to b) of the second path can be in the form of any circuit network 303 operational as a feedback in combination with the first path. A second portion (a1 to a2) of the second path can be considered to be either an open or closed controllable switch SW1, 304. The switch 304 is controllable, i.e. it can be either open or closed, in response to a control signal applied at a control input coupled to the pad Tsw1. It is shown that the control input is coupled directly to the pad, but the control input may be provided via a mode detector and/or mode changer. Thereby the circuit network 303 can be engaged or disengaged and thereby change the effective feedback of the operational amplifier and hence its transfer function. In this way different signal transfer functions can be selected. It is possible to provide alternative controllable feedback networks e.g. with more switches and more, or alternatively configured, circuit networks.

The controllable charge pump 305 is separated from the transducer 102 by means of a filter 306 which can be a low-pass filter or band-pass filter. The charge pump is controllable by engaging or disengaging a circuit 308 which may be a portion of the charge pump 305. The circuit 308 can be engaged or disengaged by means of a switch 307 with a control input received via a separate pad Tsw2 or via a mode detector or mode changer and/or by multiplexing with other inputs—e.g. that for SW1.

The capacitive transducer 102, which may be a microphone transducer is coupled as a so-called floating element between the charge pump via the filter 306 and an input of the operational amplifier 301.

The output signal from the amplifier is obviously an analogue signal, but the configuration can be changed to comprise an analogue-to-digital converter to thereby provide a digital output signal via a pad of the semiconductor die carrying the signal conditioner 103.

Figure 4:
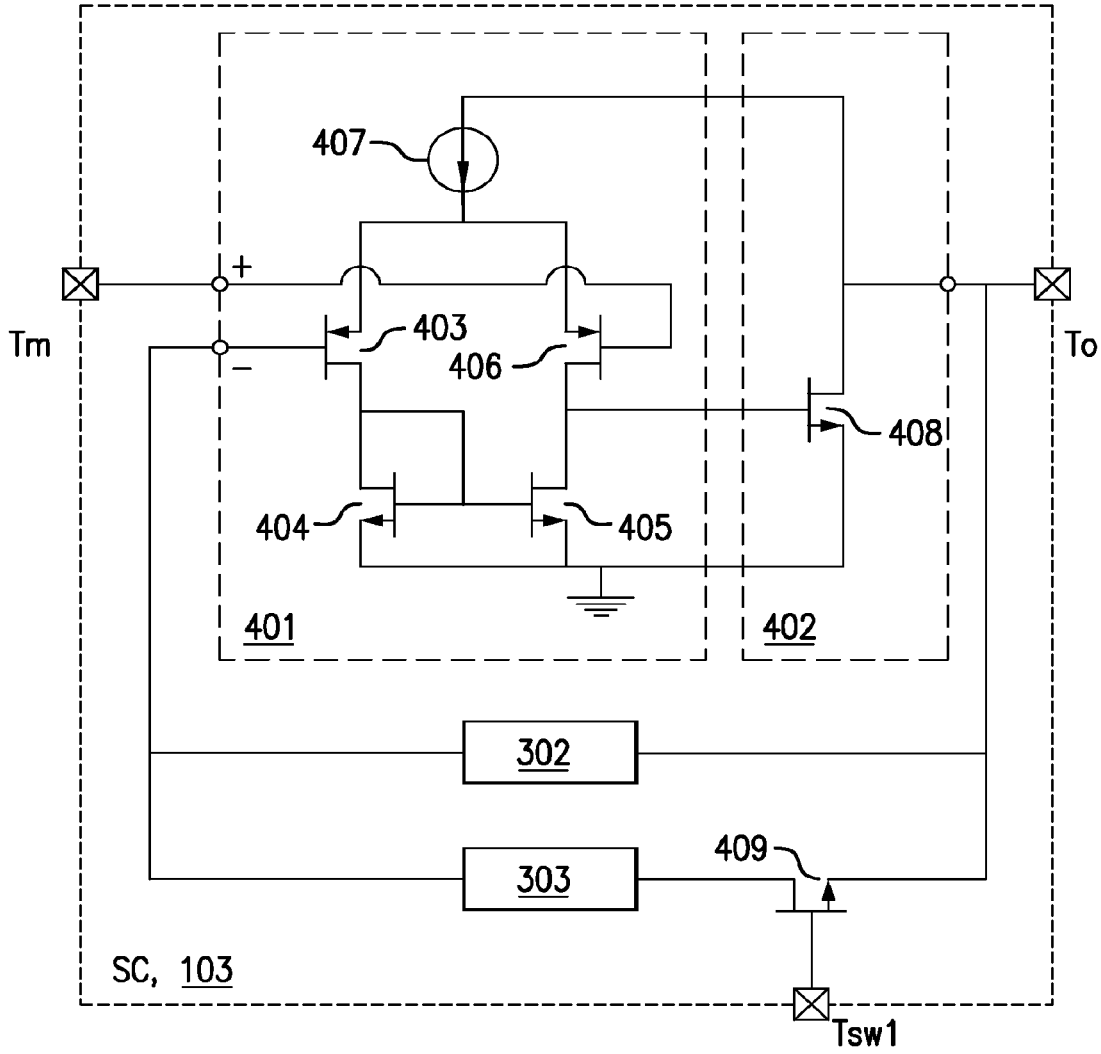
FIG. 4 shows a semiconductor die with a controllable amplifier with differential input.

FIG. 4 shows a transducer and a semiconductor die with a controllable amplifier. An amplifier input stage 401 comprises a differential pair of PMOS active devices 403, 406. The current flowing in one of the active devices 403 is mirrored by a current mirror comprising the active devices 404 and 405 as it is well-known to a person skilled in the art. The differential pair is biased by a constant current source 407. Various implementations of a differential input stage exist—for instance, the NMOS current mirror 404, 405 can be replaced by a so-called folded cascode in combination with a PMOS current mirror.

At the output stage 402 of the amplifier, an output transistor 408 is connected to receive a signal form the differential input stage. The purpose of this is to ad gain and to isolate the input stage from the output. The amplifier (401 and 402) can be considered to be a first circuit.

A second circuit is provided as a controllable feedback circuit as described in connection with FIG. 3. But, the switch SW1 is shown as an active device 409 that implements a switch.

Thus the integrated electronic circuit comprises a differential gain stage 401 with a first (+) and a second (−) input terminal, where the first input terminal (+) is coupled to the input node so as to receive a signal from the transducer, and where the second input terminal (−) is coupled to the second circuit so as to receive a signal which is controlled by the active device 409. The signal from the transducer and the signal which is controlled by the active device are coupled separately to respective ones of the first input and the second input.

The differential gain stage 401 is coupled to an output stage (402) with an output terminal To via a feedback circuit (302, 303) to provide a feedback signal. The second circuit is coupled so as to operatively change the feedback circuit in response to the control signal.

Figure 5:
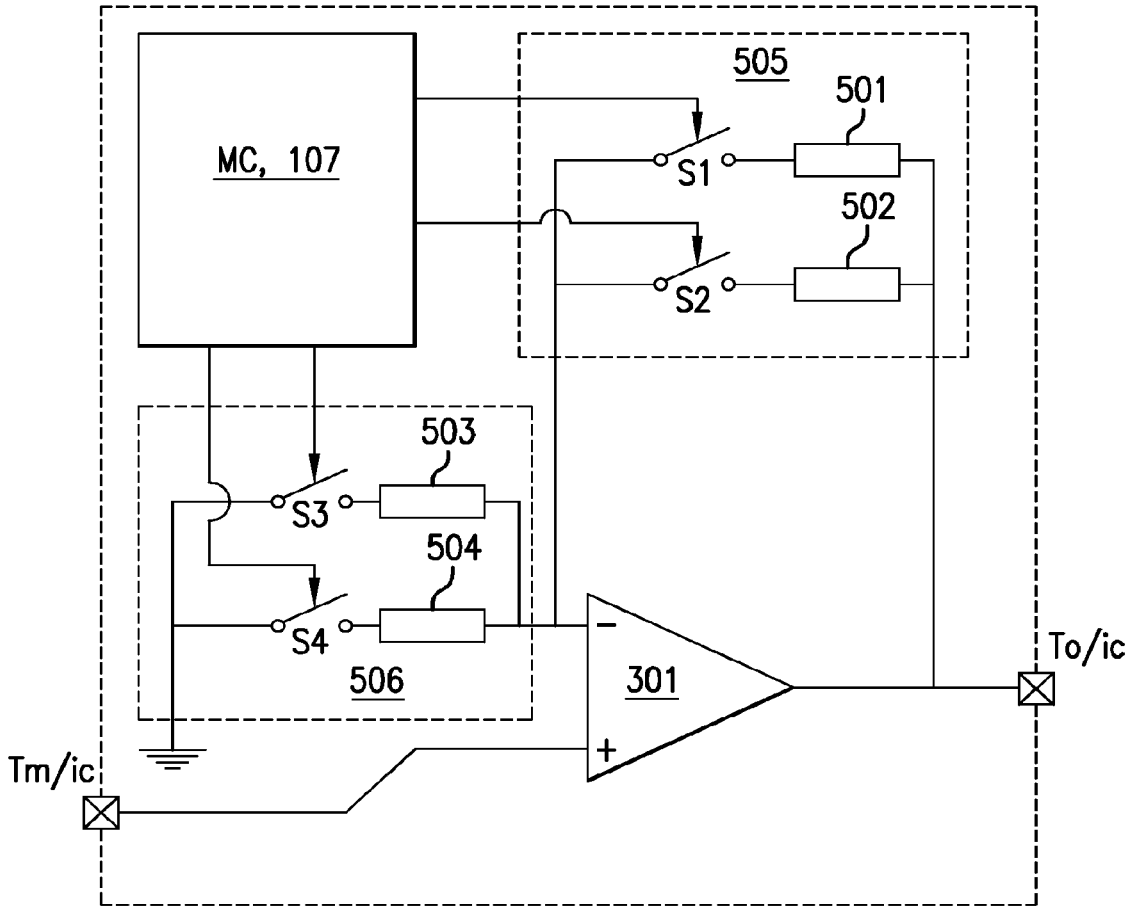
FIG. 5 shows an amplifier with a controllable transfer function.

FIG. 5 shows an amplifier with a controllable transfer function. The amplifier (which actually is a preamplifier or signal conditioner) comprises a first unit 506 and a second unit 505. The first unit 506 comprises circuits 503 and 504 (shown as two-port circuits) coupled in series with controllable switches S3 and S4, respectively, to form respective parallel paths of the first unit. The first unit can also be considered to be a two-port circuit. The first unit is coupled between ground and an inverting input of the operational amplifier 301.

Similarly, the second unit 505 comprises circuits 501 and 502 (shown as two-port circuits) coupled in series with controllable switches S1 and S2, respectively, to form respective parallel paths of the second unit. The second unit can also be considered to be a two-port circuit. The second unit is coupled between a non-inverting input of the operational amplifier 301 and the output of the amplifier to serve as a feedback circuit.

The circuits 501, 502 and 503, 504 can be implemented in various ways and can be coupled in other configurations than the shown parallel paths, where each parallel path has a switch and a circuit in series therewith. A person skilled in the art could provide such alternatives.

Parameters of the first and second units in combination operatively determine a property of the signal conditioner.

Both circuits will be subjected to large absolute variations in parameter values. But since both units are embodied on the one and same semiconductor die, and are coupled around the operational amplifier as shown, a property of the signal conditioner can be designed within fine tolerances. When this configuration is used, variations in absolute values tend to cancel out of the equation determining the signal transfer. This is highly desirable. Further, the transducer can be disregarded as a source contributing to undesired variations affecting signal transfer.

The second parameter (and consequently the property of the signal conditioning circuit) is controllable by the second circuit in that the second circuit or a portion thereof is engaged or disengaged. Thereby, one or more of different components such as capacitors, resistors and active devices can be switched in and out. If for instance an active device is coupled in to operative work in combination with another active device of the second unit, the width of the semiconductor material of the active devices in combination is increased.

The switches can be controlled by a mode changer 107. It is shown that an analogue output signal is provided, but the configuration can very well be combined with an analogue-to-digital converter.

Figure 6:
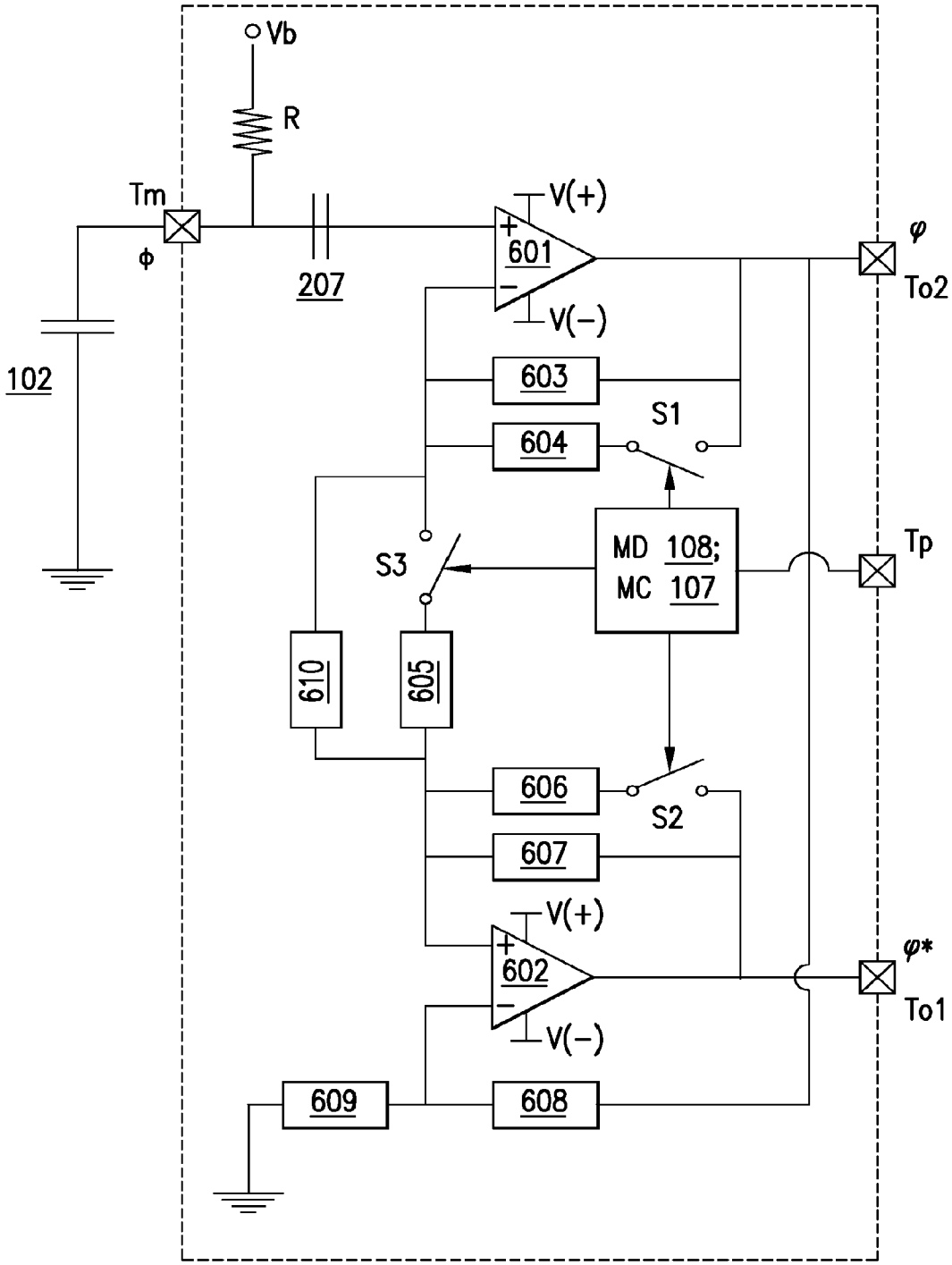
FIG. 6 shows an amplifier with a differential output.

FIG. 6 shows an amplifier with a differential output. The amplifier (or preamplifier) can be programmed in respect of gain and/or high-pass cut-off frequency and/or low-pass cut-off frequency or other properties of signal transfer such as e.g. phase delay or control of different frequency bands.

The amplifier is configured with a first operational amplifier 601 and a second operational amplifier 602 that in combination provides a differential output signal at terminals To1 and To2. The operational amplifiers 601 and 602 comprises a feedback circuit comprising circuit 603 coupled in parallel with the series connection of circuit 604 and S1; and circuit 607 coupled in parallel with the series connection of circuit 606 and S2, respectively. Each feedback circuit is couple from the output of the respective operational amplifier to its inverting input.

The inverting inputs of the operational amplifiers are interconnected by means of a circuit 610 coupled in parallel with circuit 605 and switch S3. Thereby a controllable filter transfer function can be implemented. The absolute gain in a pass-band and the bandwidth of the pass-band can be controlled.

The sensitivity/bandwidth control of the microphone is very useful in situations where the user actually whisper to the microphone in a very close distance, in this situation the sound pressure level could be very high and it could be feasible to reduce the sensitivity of the microphone in order to prevent overloads situations and reduce surrounding or background noise. In situations with high background noise is also feasible to lower the bandwidth in order to reduce overload situations in the preceding signal processing. Wind/blowing is a very good example of a background noise with an high sound pressure level (low frequency) that overloads the preceding signal processing, by reducing the bandwidth of the microphone it is possible to improve the overall sound quality.

Both the simple gain amplifier and the integrated filter amplifier can be controlled directly by the mode detector 108 and/or by the mode changer 107. The mode detector 108 and the mode controller can be implemented in different ways. The mode controller can be controlled directly e.g. via a separate terminal.

A capacitor 207 is provided as a DC-blocking capacitor and a resistor R is coupled in series with a voltage bias to the transducer.

Circuit 609 coupled between the non-inverting input of amplifier 602 and ground and circuit 608 coupled between the same non-inverting input and the output of amplifier 601 can be configured to almost force the differential output to provide a common-mode differential signal outside a pass-band and to provide a differential mode differential signal in a pass-band to thereby improve filtering.

Figure 7:
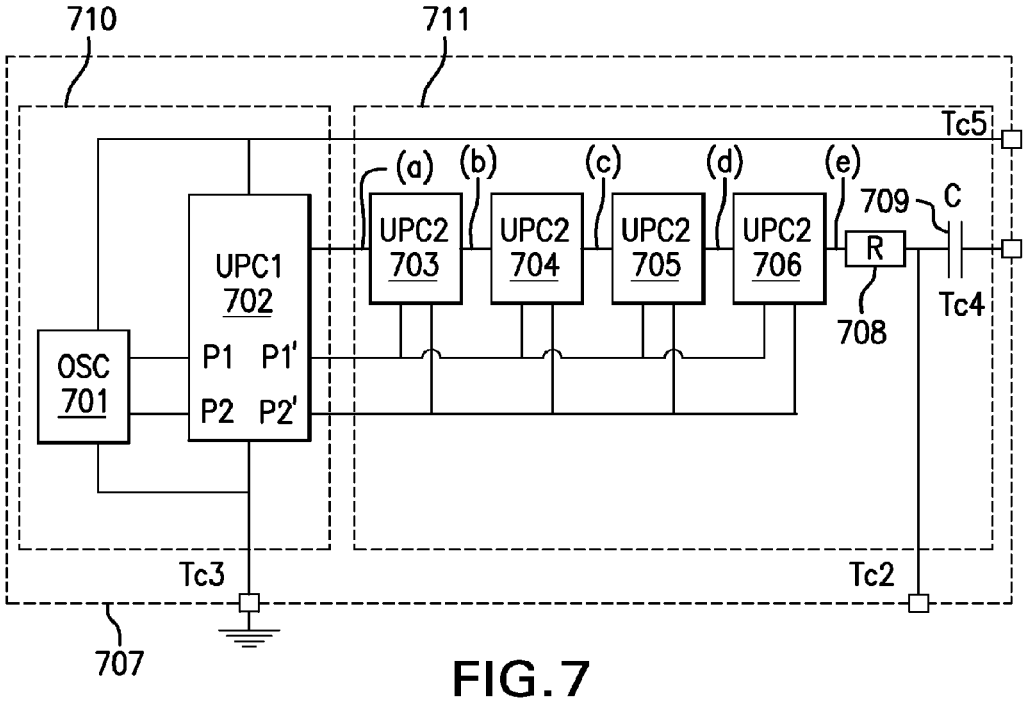
FIG. 7 shows a two-stage stage of charge pump.

FIG. 7 shows a two-stage stage of charge pump. The compound voltage pump 707 comprises a first stage voltage pump 802, UPC1 and a second stage voltage pump. The second stage voltage pump comprises a cascade of voltage pumps 803, 804, 805, 806, UPC2.

The first stage voltage pump can be implemented in various ways, but preferred embodiments of the first stage voltage pump have been disclosed in the above. The first stage voltage pump is based on an oscillator 801 which provides oscillator signals P1 and P2 phase shifted about 180 degrees relative to each other. The oscillator signals are provided to the voltage pump 802, UPC1 to provide pumped oscillator signals P1' and P2'. It is recalled from the above that the pumped oscillator signals are regulated to provide precise and at the same time relatively high voltage levels. It is further recalled that the pumped oscillator signals are provided by the circuits implemented in a low voltage section. This low voltage section is illustrated by the dashed box 810.

If the pulse amplitudes of the repeated pulses constituting the oscillator signals P1' and P2' are maximized with respect to the nominal voltage level specified for the low voltage section 810, the number of cascaded voltage pumps at the second stage can be minimized, other things being equal. Consequently, a more die area efficient design is provided.

It is recalled that any IC technology has a nominal voltage at or below which all components are specified to be operational without DC voltage breakdown. At or below the nominal voltage complex circuitry can be implemented with high performance. Above this nominal voltage level only a limited number of components are available. That is, e.g. standard CMOS transistors cannot be used as they would brake down due to the high voltage levels. The limited number of components comprise High Voltage CMOS transistors, but the technology for implementing the High Voltage CMOS transistors is expensive and the components are very bulky. Therefore it is advantageous to divide the charge pump into a low voltage section and a high voltage section.

Reverting to the description of the voltage pump: The pumped oscillator signals P1' and P2' are provided to each of the voltage pumps 803, 804, 805, 806, UPC2 arranged in cascade. Each of the voltage pumps designated UPC2 is provided with an input signal which at circuit nodes (b), (c) and (d) is characterized as a DC voltage superposed by an oscillating signal with a pulse amplitude largely about the pulse amplitude of P1' or P2'. The node (a) is preferably coupled to receive a DC signal from UPC1. This DC signal can be a ground reference, a DC level e.g. the DC supply voltage provided to the inverters 502, 503 or another DC signal.

The cascade of voltage pumps generates gradually larger voltage levels from circuit node (a) to circuit node (b), to circuit node (c), to (d) and to (e). Each of the voltage pumps can add a voltage corresponding to e.g. four times the pulse amplitude of the oscillator signals to the DC signal input to the voltage pump. However, this depends on the configuration of the pump and especially on the number of capacitors in the configuration and the magnitude of loss in the pump.

The voltage level provided by voltage pump 805 at circuit node (e) is provided via a series resistor 808, R and terminal Tc2 as a microphone bias voltage to provide an electrical charge on one of the microphone members.

The capacitor 809, C is coupled to block the pumped DC bias voltage from reaching the input stage of a preamplifier (not shown) coupled to terminal Tc4 to receive a microphone signal from the microphone member coupled to terminal Tc2 at which the bias voltage is provided.

The oscillator 801 and the voltage pump 802 is provided with operating power by drawing a current via terminal Tc5. However, the operating power could be provided via terminal Tc4 also providing the microphone signal.

Especially for telecom microphones it is expedient to apply this multistage voltage pump to obtain a relative large overall voltage pump factor per die area unit.

Preferably, the voltage pumps 803, 804, 805 and 806, UPC2 are of the same type; preferably they are similar or identical.

High voltage IC components require larger mutual spacing, deeper wells, thicker gate oxide etc. That is, physically they are different components. In the following a voltage pump of the Dickson type for implementation in the high voltage section is described.

Figure 8:
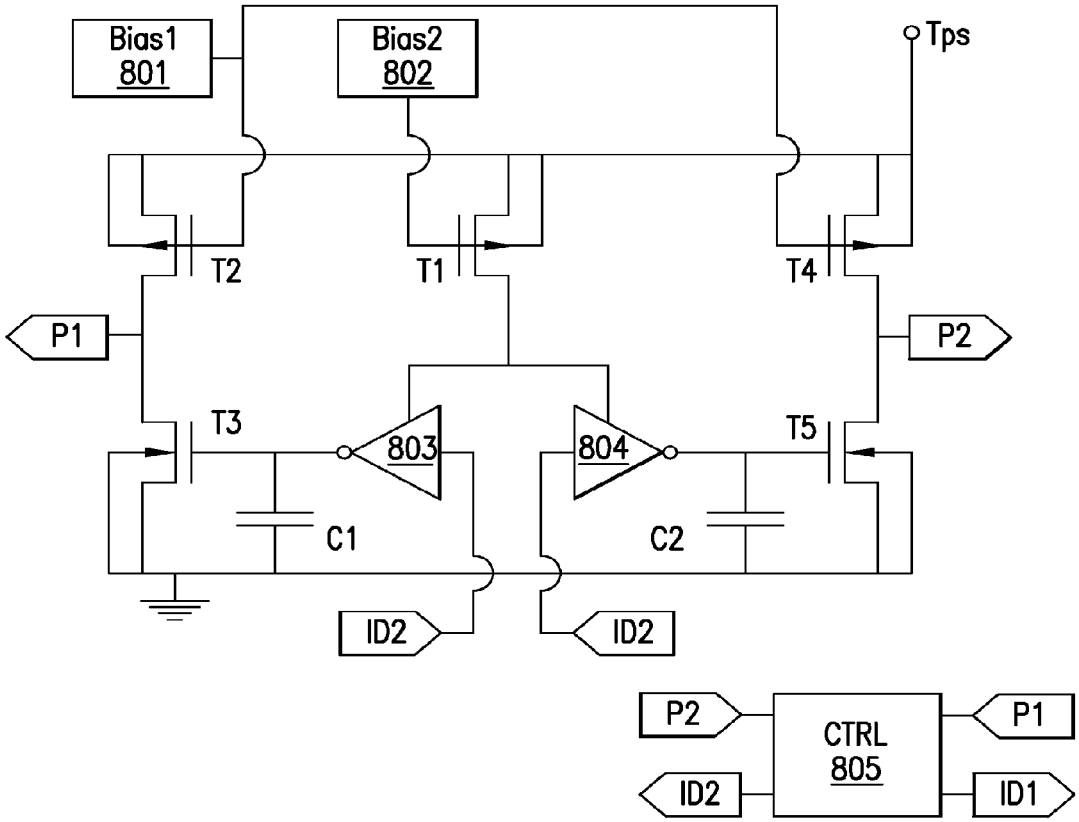
FIG. 8 shows a first stage of a charge pump in detail.

FIG. 8 shows a first stage of a charge pump in detail. This embodiment is an oscillator shown in greater detail. As it appears from FIG. 3 the oscillator is built around two inverters 403 and 404. The inverters 403 and 404 are powered by a current source T1 that is biased by a bias circuit 402, Bias2 to make T1 provide a constant current.

The inverters are configured to either draw current through an internal element, e.g. a resistor or transistor, or through its output. Whether the inverter is in a state where current is drawn through the internal element or in a state where current is drawn through the output is controlled in dependence of whether the voltage level at its input, provided at circuit points ID1 and ID2, is above or below a threshold voltage level.

The output of the inverters 403 and 404 is coupled to respective capacitors C1 and C2. When the inverter 403, 404 is in a state where current is drawn through the output, the respective capacitor is charged and the voltage across the capacitor will increase. Alternatively, in the other state of the inverter, the capacitor will be discharged through the inverter or through another load.

The voltage across the capacitors C1 and C2, dependent on their charge level, controls respective transistors T3 and T5. This is achieved by a circuit node connecting the gate terminals of transistor T3, capacitor C1 and output terminal of the inverter 403. Correspondingly, a circuit node connecting the gate terminals of transistor T5, capacitor C2 and output terminal of the inverter 404.

Transistors T2 and T3 are coupled as constant current sources in series with transistors T3 and T5, respectively. The transistors T2 and T4 are biased by a bias circuit 401, Bias1. T3 and T5 are controlled by the voltage level across the capacitors C1 and C2 which in turn are charged or discharged as determined by voltage levels at their input ID1 and ID2. Thereby buffered oscillator signals P1 and P2 are provided.

The control circuit 405 is provided to control the circuit to provide out-of-phase oscillator signals P1 and P2. Preferably, 180 phase shifted signals are provided.

Figure 9:
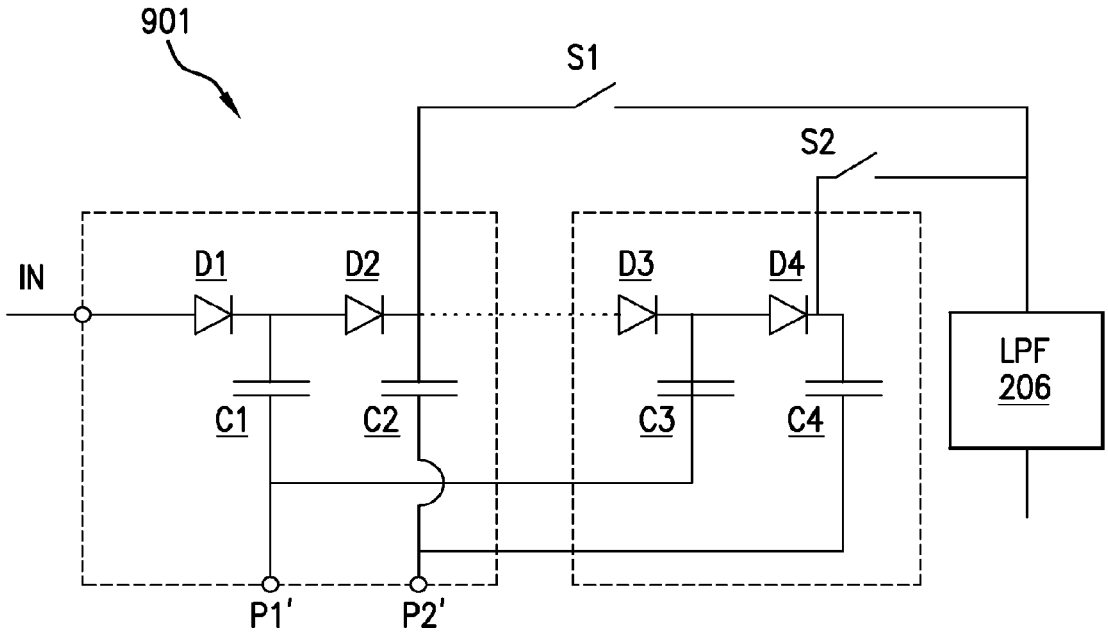
FIG. 9 shows a second stage of a charge pump in detail.

FIG. 9 shows a second stage of a charge pump in detail. This voltage pump is shown in the form of a Dickson-converter and constitutes preferably the modules 703-706, UPC2 of the compound voltage pump. In this embodiment the Dickson-converter comprises four diode-capacitor stages, but fewer or more stages can be applied. The Dickson voltage pump usually consists of several diode-capacitor stages. The numbers of sections depend on pulse amplitude of oscillator signals P1' and P2' and the desired output voltage. The voltage pump 901 receives an input voltage signal. In case the pump 901 is coupled in a cascade the input signal can be provided by a preceding pump module as a DC signal superposed by an oscillating signal largely corresponding to P1' or P2'. The input signal is provided at the terminal designated 'In' and provides a pumped output signal at its terminal designated 'Out'. The pump is operated by the oscillator signals P1' and P2' to alternately charge the capacitors C1, C3 and C2, C4, respectively. When the voltage pump has reached a normal operating state and the pumped output voltage thus has reached a nominal level, each diode-capacitor stage adds a voltage step equal to the oscillator pulse amplitude minus any loss at the stage. Consequently, an output voltage greater than the input voltage and the pulse amplitudes can be provided.

The Dickson charge pump or other types of charge pumps or voltage step-up circuits can be configured to provide control of the output voltage level. A person skilled in the art will be able to provide such configurations.

In the shown configuration, controllable switches S1 and S2 can be used to pass on a node in the cascade providing a voltage level below the output level to an output terminal. Switch S1 passes on an (intermediate) circuit node between two diodes D2 and D3 of the cascade while switch S2, coupled to the output of the last stage in the cascade, disconnects the output from the output of the controllable charge pump. The state of the switches S1 and S2 can be altered such that the intermediate node is operatively disconnected from the output while the output of the last stage in the cascade is coupled to the output.

The output of the charge pump is provided to a low-pass filter 206. As mentioned other configurations that can be made controllable exists.

Figure 10A:
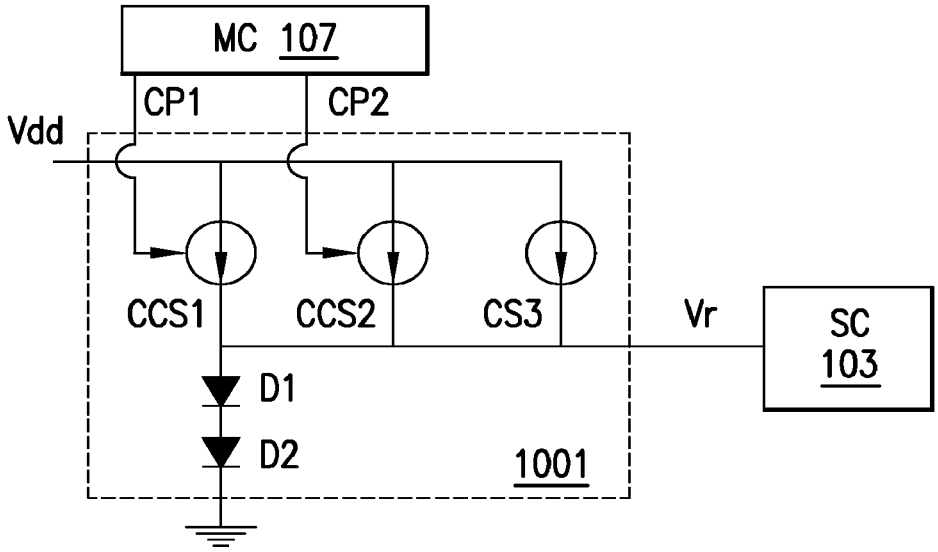
FIG. 10*a* shows a controllable reference generator.

FIG. 10*a* shows a controllable reference generator. The controllable voltage reference generator implements a portion of the mode changer 107. The voltage reference generator is coupled to a ground reference and the power supply Vdd. The voltage reference generator provides an output voltage reference level Vr to the signal conditioner 103 (e.g. comprising an amplifier and/or sigma-delta modulator). The current in the voltage reference generator is determined by the control signal provided by the mode detector. The control signal is provided via inputs 'CP1' and 'CP2'.

The reference generator comprises two controllable current sources CCS1 and CCS2, which are controlled by the control signals, and a fixed current source CS3. The current sources are coupled in parallel to provide a determined output current, Vr.

Since the current drawn through the current sources is converted to the reference voltage Vr by means of two diodes D1 and D2 in series with the current sources, and since the diodes has a non-linear current-voltage characteristic the reference voltage is substantially maintained although the current is reduced.

Figure 10B:
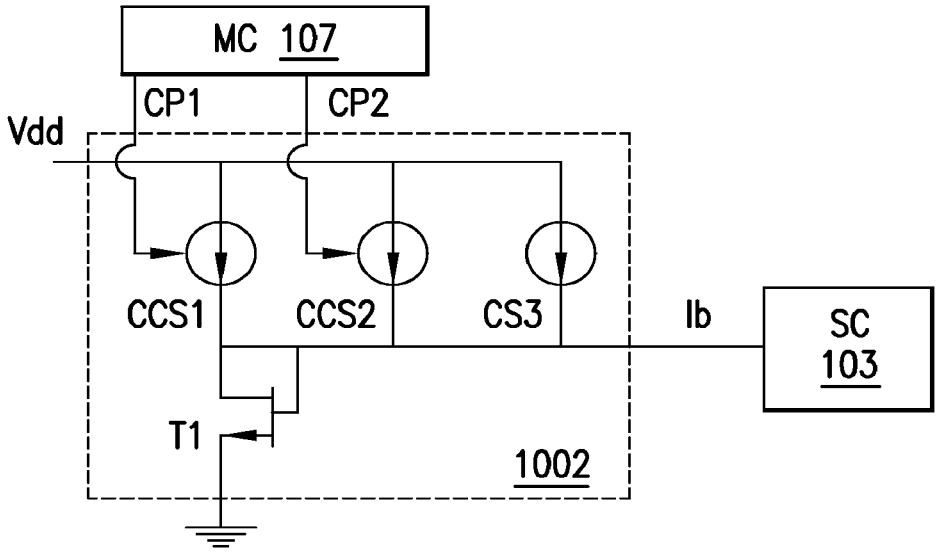
FIG. 10*b* shows a controllable bias generator.

FIG. 10*b* shows a controllable bias generator. The controllable bias generator has a configuration similar to the controllable reference generator.

In this aspect the current is independently controllable via a digital ON/OFF signal. When the relaxed performance mode is enabled the corresponding current sources is switched off and less current would be flowing in the bias circuitry of the different blocks of the digital microphone. In the shown configuration, a minimum current of e.g. 2 uA is always turned on by means of CS3, even when the microphone is in sleep mode.

Figure 10C:
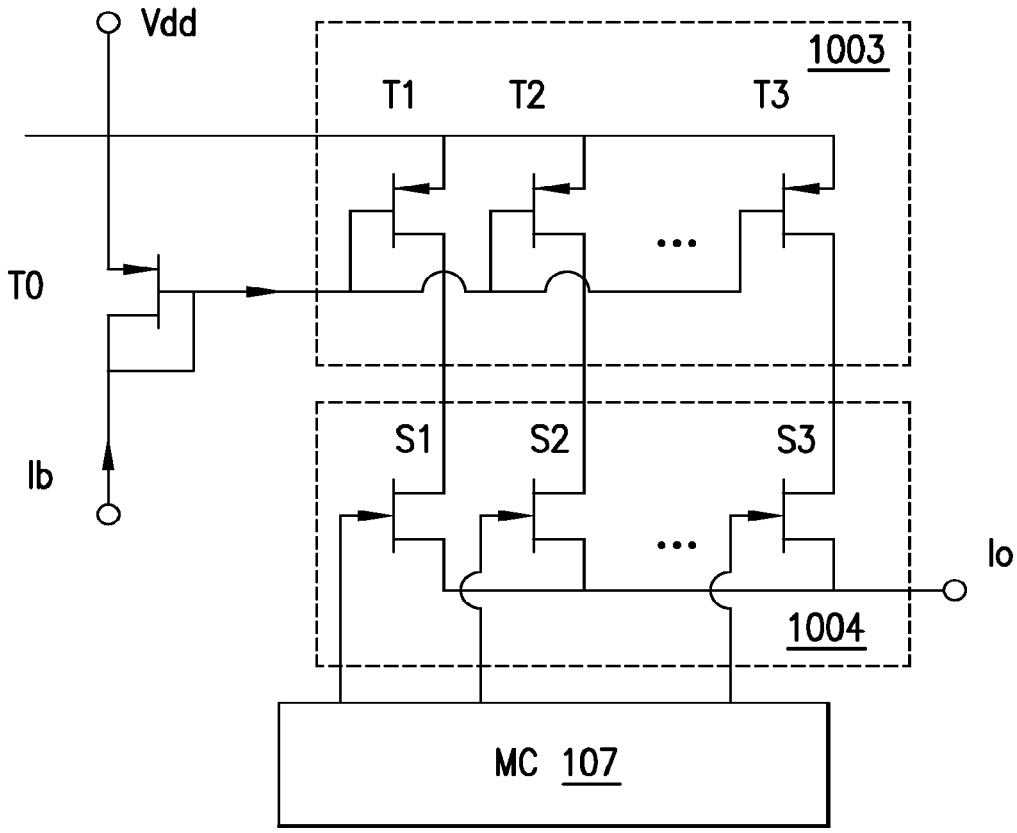
FIG. 10*c* shows a controllable bias generator with a current source array.

FIG. 10*c* shows a controllable bias generator with a current source array. A transistor T0 is coupled at its drain to receive an input reference current Ib and at its source to a supply voltage, Vdd. The gate of the transistor provides a current to an array 1003 of transistors. T1, T2, . . . T3. Only three transistors are shown, but the array can comprise any number of transistors. The transistors T1, T2, . . . T3 are coupled to each provide a current through the drain-source passage.

The transistors of the array are coupled such that the current flowing in the drain-source passage is provided to a respective controllable switch S1, S2, . . . S3 so as to control which (how many) of the transistors that are to contribute to the current, Ib, provided through an output. Thereby a selectable level of discrete levels of current can be provided as output.

Since the transistors of the array is provided on the one and same semiconductor die the discrete levels of current can be provided with small tolerance.

Figure 11:
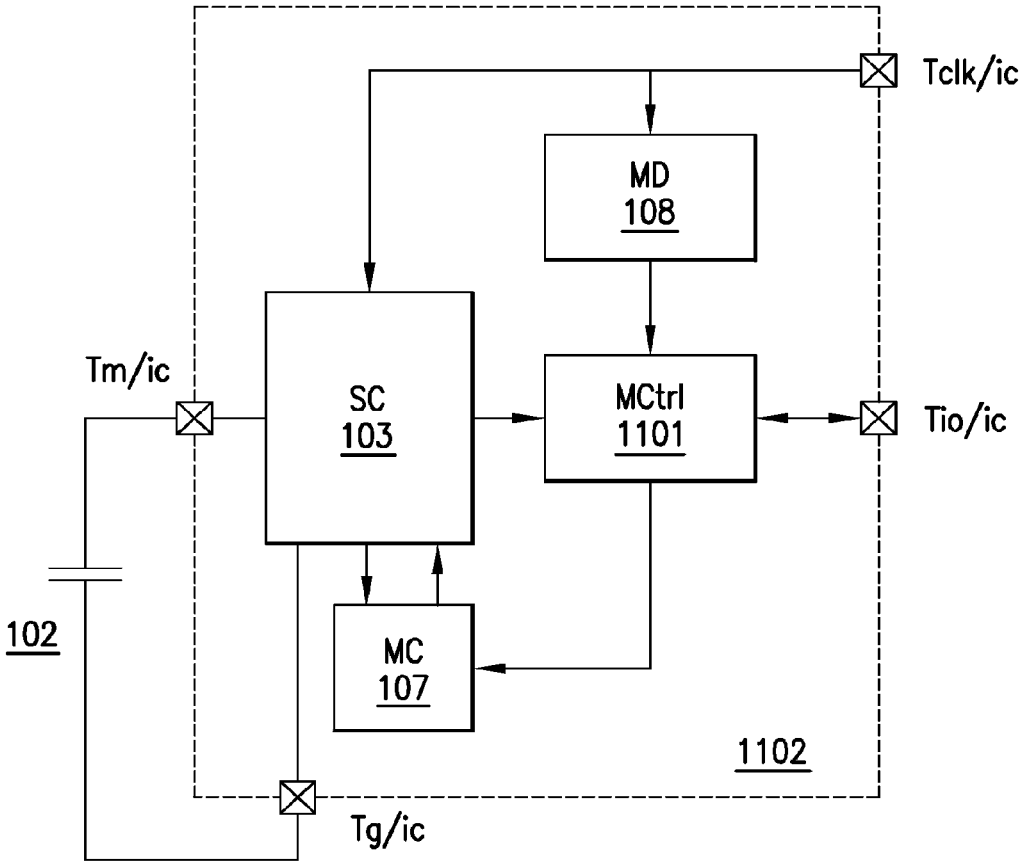
FIG. 11 shows a transducer with a programmable mode.

FIG. 11 shows a transducer with a programmable mode. The microphone comprises a capacitor microphone, 102, an semiconductor die and a microphone capsule. However, for the sake simplicity the microphone capsule is not shown. The integrated circuit comprises a signal conditioner 103 which provides an analogue or digital output signal a mode detector, a mode changer 107 and a mode controller.

The mode detector 108 is configured to detect a portion of programming signal, which carries information for selecting a mode. As described above, the selectable modes can comprise a normal operation mode and one or more sleep-modes and/or relaxed performance modes. The shown embodiment is configured to enhance the programming by providing a mode controller which, in a selected mode, can receive another portion of the programming signal to provide more detailed programming parameter values or instructions.

In the shown configuration, the mode detector 108 receives an input signal e.g. a clock signal or a power signal and retrieves a programming signal multi-plexed with the input signal. The programming signal is adapted to make the mode detector 108 detect one of at least two modes. In response to a detected mode, the mode detector 108 provides a control signal to the mode controller indicating the detected mode.

The mode controller has at least two corresponding modes: a normal operations mode wherein signals from the signal conditioner 103 is passed on to be output on the terminal Tio/ic; and a programming mode wherein the mode controller receives the other portion of the programming signal from an external circuit via the terminal Tio/ic while output from the signal conditioner 103 to the mode controller is tri-stated. In the programming mode, an external circuit can provide the other programming signal to the mode controller to provide parameter values or programming instructions. The mode controller receives the programming signal while it is in the programming mode and register values of the programming signal for operating the signal conditioner 103 according to these values in the normal operation mode when the programming mode has been leaved. The signal conditioner 103 is operated according to the values in the normal operation mode by means of the mode changer 107.

Consequently, an external circuit can select a programming mode of the microphone and supply parameter values or program instructions to program the performance of the signal conditioner 103 when the signal conditioner 103 operates in a normal operation mode. The normal operation mode can be selected by the external circuit or the normal operation mode can be entered when the programming mode terminates after a given programming sequence supplied by the other programming signal. Thereby, a relatively advanced programming interface can be achieved despite the constraints given by the limited die area consumption, power consumption, number of die terminals and the limitations given by the available die technology.

Figure 12:
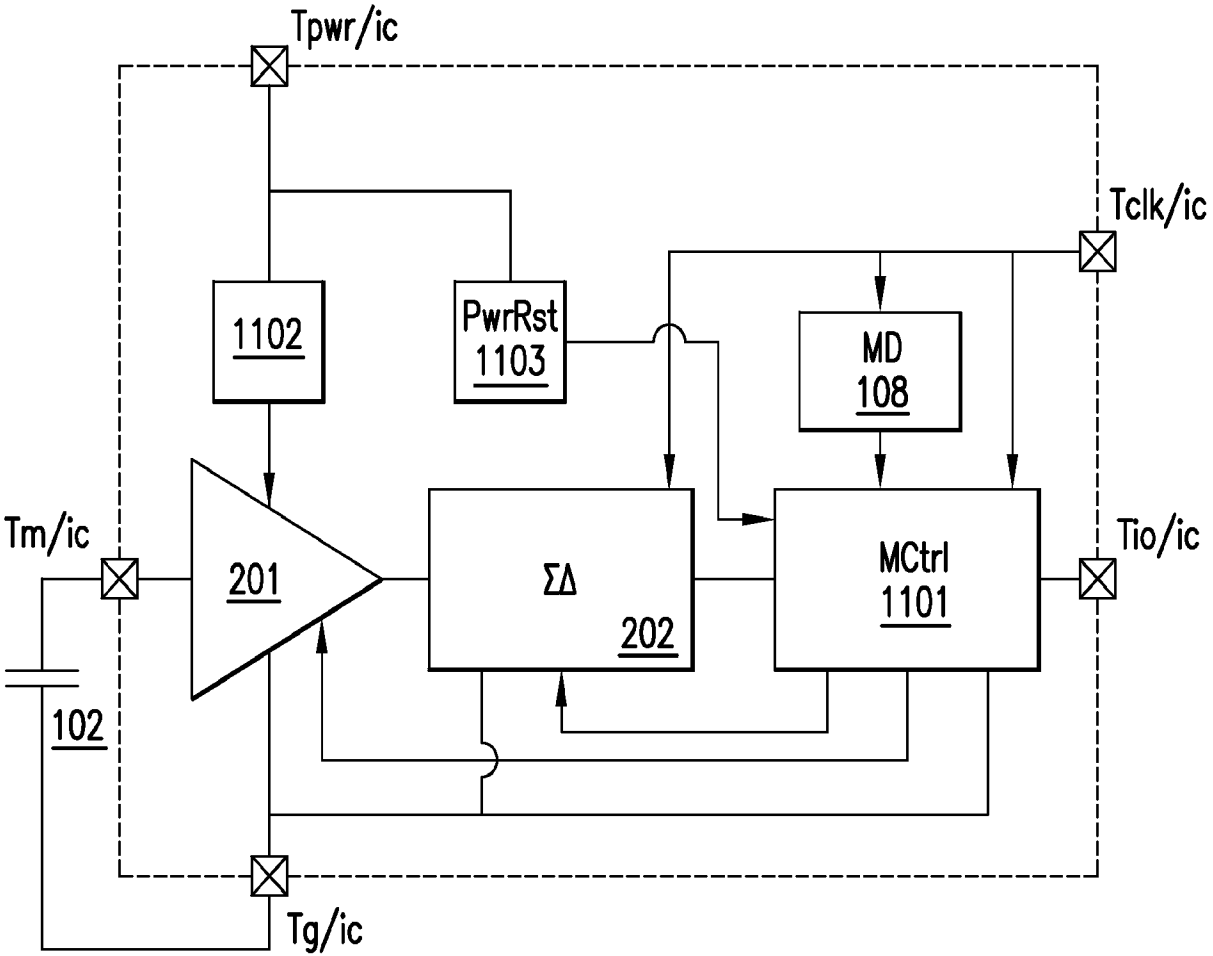
FIG. 12 shows a transducer with power-up reset.
Figure 13:
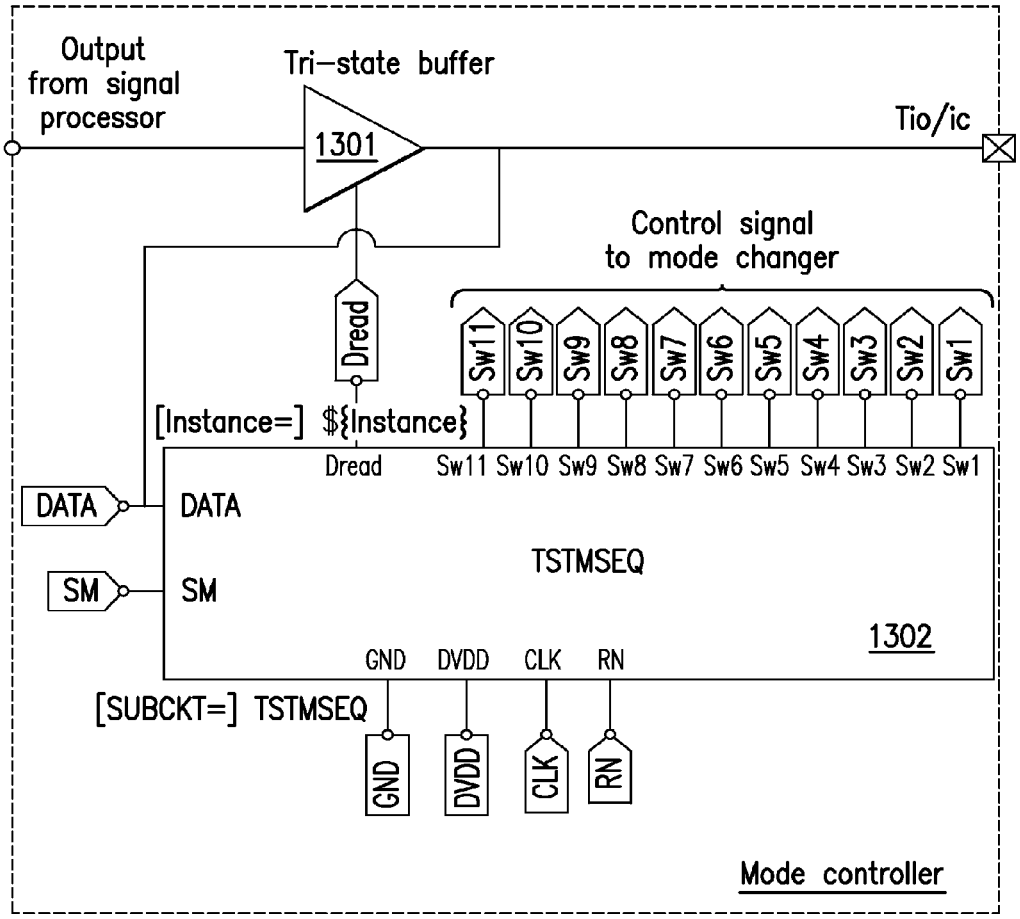
FIG. 13 shows a simplified mode controller.

FIG. 12 shows a simplified mode controller. The digital microphone comprises a capacitor microphone 102, an amplifier, a sigma-delta modulator and a mode controller. The sigma-delta modulator provides an analogue-to-digital conversion of the microphone signal provided by the capacitor microphone to thereby provide a digital pulse-density modulated PDM signal. The digital signal is provided via a terminal Tio/ic. A voltage regulator is configured to provide power supply to the amplifier.

Further, the digital microphone comprises a mode detector 108 coupled to receive a clock signal via terminal Tclk/ic and to receive a programming signal time or frequency multiplexed with the clock signal. In response to the programming signal, the mode detector 108 is able to control the mode controller. The mode controller can be controlled to be in one of at least two modes. In a first mode the mode controller provides the digital signal from the sigma-delta modulator to the terminal Tio/ic. In a second mode the mode controller tri-states the signal from the sigma-delta modulator and is coupled to receive a programming signal via the terminal Tio/ic. In response to the programming signal received by the mode controller, the amplifier and the sigma-delta modulator can be controlled e.g. by a mode changer 107 as described in the above and in the below. Further, other circuits can be controlled e.g. a voltage pump providing an OTP high voltage or a bias voltage to the capacitor microphone.

A preferred embodiment of providing communication with the integrated circuit is described below. The communication is in accordance with a communications protocol denoted DigMicCom and it enables transfer of programming signals from an external circuit to the integrated circuit.

The DigMicCom is an easy way to communicate with an analogue or digital microphone that has at least two I/O pins/Pads to support the clock and data signals. The purpose of the DigMicCom is to make a simple programming of the digital/analogue microphone even when the IC (ASIC) is placed inside the microphone capsule.

The DigMicCom is a simple digital input/output interface with a special protocol that enables test equipment or handset or another external circuit. to communicate with the microphone even during normal operation mode. It should be noted that during the program sequence of the microphone the normal audio data is disabled and instead the DigMicCom protocol is running on the DATA/CLOCK pins, this program sequence would normally last less than 100 usec. From a users' perspective this short time interval where the microphone does not provide a microphone signal is hardly noticeable.

In this way the microphone can be programmed with special sensitivity settings, SNR ratios (or performance), current consumptions and even be programmed to output internal analogue nodes of the ASIC on the DATA pad in e.g. a test situation. Further DigMicCom could be used, during manufacturing of the microphone, to control defaults settings of the microphone (such as gain/sensitivity), these default settings can be one time programmable, OTP.

In order to support the DigMicCom protocol it is suggested to have a TSTMSEQ block, SleepMode detector 108 block and Power On reset block integrated on the ASIC that is mounted in the microphone capsule. The TSTMSEQ is a digital block that controls the DigMicCom protocol/switches in the microphone and the Sleepmode detector 108 has at least one digital output used to control the sleepmode i.e it signals when the Clock signal is less than app. 100 kHz. The three blocks are sketches out in the figure below with some additional block usually present in a digital microphone.

In a simple configuration the mode detector 108 has two modes: a normal mode and a sleep mode. The transition from sleep mode to normal establishes an event, which brings the microphone into a programming mode, with finite duration, wherein the microphone can receive a programming signal. Since the programming signal can be transmitted via the same terminal as the output signal, the microphone may not be able to provide a microphone signal to an external circuit before the programming mode has lapsed.

The mode controller comprises a tri-state buffer which receives a microphone signal from the signal conditioner 103 and which provides the microphone signal at the terminal Tio/ic when the output of the tri-state buffer is not tri-stated. When the output of the tri-state buffer is tri-stated, the circuit block TSTMSEQ is coupled to receive a programming signal from an external circuit via the terminal Tio/ic. Thus, the microphone signal and the programming signal shares a common terminal Tio/ic in a time-multiplexed manner. The TSTMSEQ block is described in more detail in the below.

When the DigMicCom protocol is implemented, a central portion of the mode controller is designated TSTMSEQ. The purpose of the TSTMSEQ is to control the Di102Com protocol at the receiving site. The microphone always work as a slave and will accept commands from its master which could be e.g. the CPU, DSP or Audio Codec of an external circuit in the form of e.g. a mobile handset or a some kind of test equipment. Further, TSTMSEQ has a number of control output signals SW1, SW2, . . . , SWn that are programmed via an Nprog bits sequence that are sent to the microphone under control of the DigMicCom protocol.

Example of a Di102Com Slave

In the following an example of designing a Di102Com slave is explained in details. The Di102Com slave is used to control 11 digital outputs, numbered from SW1 to SW11 in this example the Di102Com is to be used in test of the microphone i.e the digital outputs SW1 to SW11 is used to control some switches in the analogue part of the ASIC that connect the DATA pad to some internal analogue nodes inside the ASIC. In this example it is assumed that the Power On reset circuits signals is controlled from a different block on the ASIC and the Power On Reset signals is available to the TSTMSEQ circuits. It is also assumed that the Sleep Mode detector 108 is implemented on the ASIC and the Sleep mode detect signal is available to the TSTMSEQ. The TSTMSEQ electrical interface block is sketches out in the figure below.

In principle these control signals are output of a register—typically a D-flip flop or D-latch. These registers would be set to their default value at power up, normally this default value after power on reset is set low level value.

The Electrical Interface of the TSTMSEQ Block

| Terminal function | Terminal name | signal direction | Comment |
|---|---|---|---|
| power supply | DVDD | Power | |
| Ground | GND | Power | |
| Power on reset | RN | In | Async. Active on low reset |
| Sleep Mode indicator | SM | In | From Sleep mode circuits, active high |

-continued

| Terminal function | Terminal name | signal direction | Comment |
|---|---|---|---|
| I/O indicator | Dread | OUT | Control of DATA tristate buffer PAD, active high |
| Clock signal | CLK | IN | From CLK Pad |
| Switch control | Sw11-Sw1 | OUT | Active low digital outputs |
| Input data | DATA | IN | Input from DATA pad |

RN: The reset pin must be supplied to the TSTMSEQ after the power to the TSTMSEQ is stable and the TSTMSEQ is functional. The signal must be active for a least one clock period. The actual timing with the other PIN signals can be found in the Signal Timing paragraph. The RN is asynchronous with the CLK.

SM:

This input pin indicates when the circuit is in sleep mode. A '1' indicate that the circuit is in Sleep mode and this happens typical after the clock is removed from the circuits. When the clock is turned on again it is important that SM pin stays high for a least 1 clk periods since the TSTMSEQ sample the SM pin on the negative clock edge, this indicate that the circuit has been in sleep mode and just waken up. There are no requirements to the SM pin when is should go to its '0' state again, but this need to happens before the next SW program cycle starts.

Dread:

The purpose of the Dread pin is to indicate when the TSTMSEQ wants to read data on the DATA pin. I.e this output pin can be used to control when the DATA PAD of the circuit should be in input mode. A '1' indicate that the DATA PAD of the circuit must be in 'input mode' a '0' indicate that the DATA PAD is allowed to be in tristate or normal output mode. The DATA PAD on the ASIC must be able to change either from high-Z or output mode to input mode less than half a clock cycle.

CLK:

A clock signal must be supplied to the TSTMSEQ, this clock signal is preferable taken directly from the ASICs CLK PAD. All the synchronous flip-flops inside the TSTMSEQ change its state at the negative clock edge.

Sw1-Sw11:

A total of 11 switches can be connected to the TSTMSEQ. These output pins are active low I'e a '0' indicate that the corresponding switch should be turned on. The output of each Sw is changed to its active state after the whole program cycle is finish, this means that the contact never will be turned on as long as the DATA PAD is in its input mode.

DATA:

The DATA pin must be connected to the DATA PAD and is controlled according to the Dread pin. Please do not confuse the DATA PAD with the DATA pin, the DATA pin is placed on the TSTMSEQ block and the DATA PAD I/O pad of the ASICS.

3.2 Timing Diagrams

In this paragraph a typical event is described. These events turn on the testmode option in the TSTMSEQ and program the 11 switch controls (SW1-SW11) with the following settings:

SW1: 1 (switch turned off)
SW2: 0 (switch turned on)
SW3: 1 (switch turned off)
SW4: 1 (switch turned off)
SW5: 0 (switch turned on)
SW6: 0 (switch turned on)
SW7: 1 (switch turned off)
SW8: 0 (switch turned on)
SW9: 1 (switch turned off)
SW10: 1 (switch turned off)
SW11: 1 (switch turned off)

The DigMicCom Protocol

The DigMicCom uses a special preamble detection scheme in order to start a programming sequence. This preamble scheme is used as a unique word to enter or start the programming sequence of the microphone. The problem is that during normal operations condition it is not allowed to enter such a programming mode. DigMicCom use a preamble consisting of Npulse with a frequency that is higher than the clock frequency.

By applying a number of pulses (Npulse) on the DATA PAD for a specific number of clock cycles (Nclk) and assure that Npulse>Nclk it is possible to distinguish the preamble from normal audio data bits since the audio data bits always shift synchronous with the clock signal. In some application two digital microphones are placed on the same DATA wire i.e a left and right microphone channel shifting the DATA output bit on the raising and falling edge of the clock respectively, each microphone keeping the DATA pad in high impedance state in the low and high clock period respectively. The timing diagram of the nokia format is sketched out in the figure below where a dashed DATA1 (left)/DATA2 (right) indicate that the corresponding microphones DATA pad is in a high impedance tri-state mode. In such an application it's mandatory to have a unique word that is different from the normal audio bits on the DATA wire in order not to enter a false programming bit sequence.

So in other words: The DigMicCom preamble detection scheme consists of asynchronous look for Npulse (e.g. 28 pulses) in a time frame of Nclk clock periods (e.g. 18 clock periods), if exactly Npulse are detected then a correct preamble is detected.

The TSTMSEQ could constantly look for Npulse in a Nclk time frame i.e count the number of pulses in the last Nclk period updating the count for each new clock cycle. But this is cumbersome and expensive in power, instead the DigMicCom only looks for the preamble after power up or when the microphone exits the sleepmode. In this way the Power on reset block and the sleepmode detection block provide important information for the TSTMSEQ block.

The DigMicCom protocol is described in more detail in connection with the below state diagram.

Figure 14:
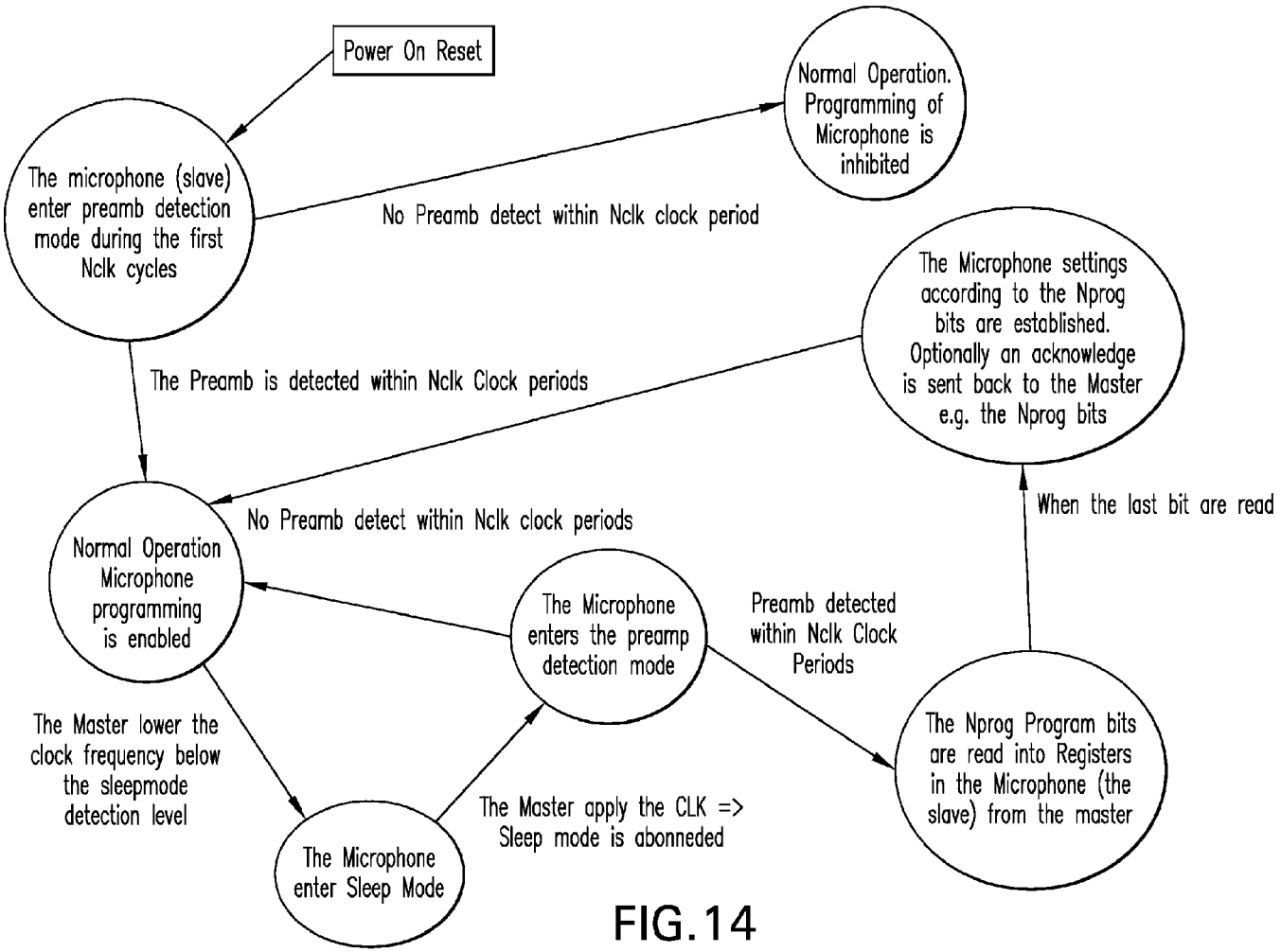
FIG. 14 shows a state-diagram of a communications protocol.

FIG. 14 shows a state-diagram of a communications protocol. After power up the TSTMSEQ start with the defaults settings off the SW1, SW2 . . . SWn control bits. After Power up the Microphone (the Slave) enters a preamble detection mode where the DATA PAD is set to a high impedance tristate mode and during the first Nclk cycles the Microphones TSTMSEQ counts the number of pulses on the DATA line. The next mode of the microphones TSTMSEQ depends if there has been preamble detection, i.e mode 2) or no detection mode 3). The dashed line in the figure above indicates that this preamble on power up could be omitted, in this case the TSTMSEQ shift directly to mode 2). In this mode the microphone works in a normal operations mode sending audio data on the DATA pad. In this mode the SW1, SW2, . . . SWn control register bits is not altered, either from power up or the last the programming sequence. When the Master reduce or turn off the clock the microphone enters sleepmode which is detected by the TSTMSEG/Sleepmode detector 108 and the TSTMSEQ shift to mode 5). If no preamble detection at power up then it goes directly to mode 4). In this mode the microphone cannot be programmed and it use it defaults power on settings of the SW1, SW2 . . . SWn control bits. In this mode the preamble detection scheme is active the first Nclk clock cycles after the CLK is applied, if the preamble is detected it goes to mode 6) otherwise it returns to mode 2). In this mode the master is sending its programming bits that sets the SW1, SW2, . . . SWn control bits. The Slave starts reading these bits after the first transition of the Nclk'th clock cycle after exit of sleepmode (this is well defined time stamp). The TSTMSEQ then change to mode 7). In this mode the TSTMSEQ could send back an acknowledge signal to indicate that the programming bits are correct received on the DATA line or/and simply just activate the just received programming bits, from here it returns to mode 2) and start all over again.

DigMicCom Protocol and Two Mics. On the Same DATA Wire

The DigMicCom protocol also support when two microphones are connected to the same DATA wire using the same clock. In this configuration the normal DATA audio bit is send on the DATA wire in each half period of the Clock as described above.

Using the Protocol as described above means that both of the microphone (the left and right) would received the same command from the master. Here it is not advisable to have the microphones sending an acknowledge signal since this could cause a BUS conflict on the DATA wire. So the protocol described above is still acceptable in this case.

If different commands needs to be send to the left respectively the right microphone then a dedicate bit (or more) in the programming bit sequence needs to be added in order to select the left or right microphone, this bit field in the program sequence is called L/Rsel.

When a command is about to be sent to the Left microphone then the MASTER, as described in previous section, puts the two microphones in sleepmode by shutting down the clock, then apply the clock again, send the preamble and afterwards the programming sequence where the L/Rsel bit field indicate that this program sequence is only to be stored by the Left microphone. The Left microphone could optionally send back some kind of acknowledge. During the acknowledge timeframe the Right microphone DATA pad has to be tri-stated.

It is advisable to place the L/Rsel bit field as the first bit(s) in the program sequence, in this way some logic could be saved.

Figure 15:
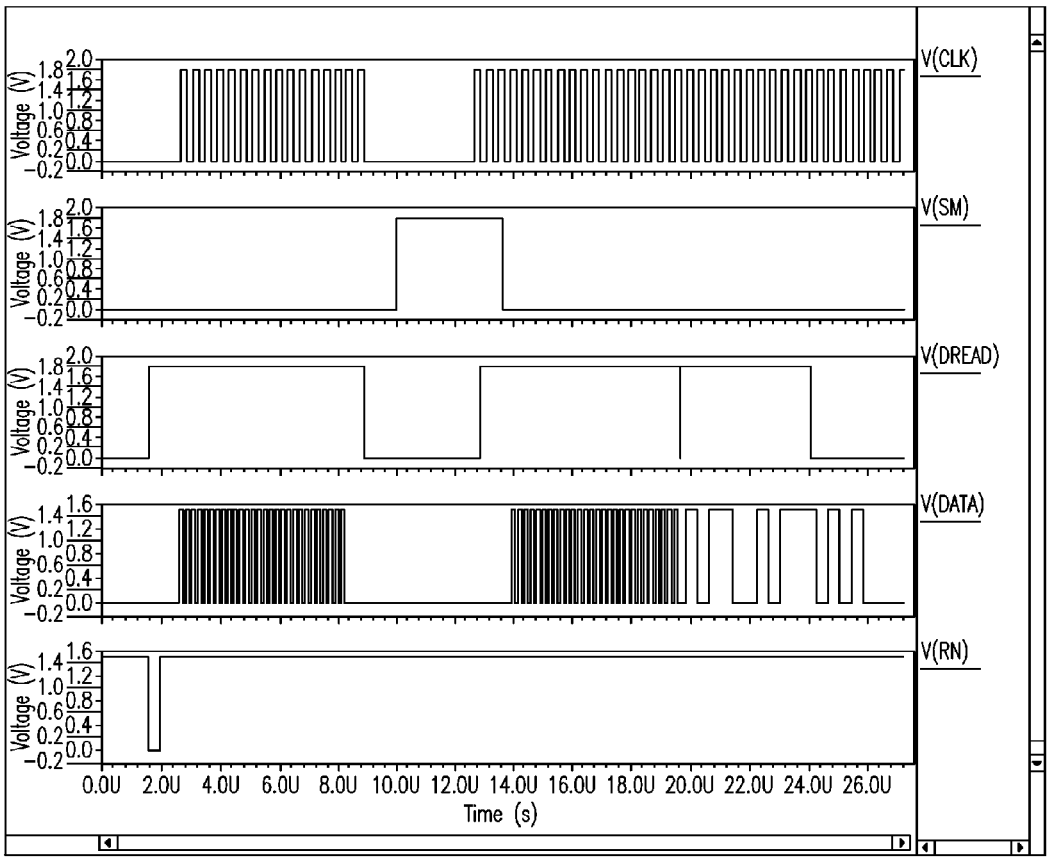
FIG. 15 shows a timing diagram of signals in accordance with the protocol.

FIG. 15 shows a timing diagram of signals in accordance with the protocol. The RN pin is abandoned after 2 usec, and CLK signal held to gnd. After power up it's crucial to assure by design that the RN pin is abandoned after a maximum time: TmaxRN. This is due to the fact that the CLK/DATA signal is controlled by the external test equipment (or the evaluation board) and this equipment has to wait until the RN is abandoned before applying CLK/DATA.

When t>TmaxRN, the CLK and 24 pulses (the preamble) is applied on the DATA, here the output pin DREAD indicate that TSTMSEQ expect to read data and DREAD should be used to control the DATA PAD of the A300 die.

When 16 CLK periods has elapsed the internal TSTm bit is set, this happens at t=8.8 usec and indicate that the TSTMSEQ is allowed to accept SW data bits at the next sleep mode cycle.

The CLK is then removed (or connected to GND) and after a while (TSMDon) the Sleep mode detection circuit indicate that the circuit is in sleep mode by setting the SM bit high (at t=10.0 usec). The parameter TSMDon is given by design and is the maximum time it takes from the CLK is removed until the Sleep Mode Detection circuit set the SM bit high.

At t=12.6 usec the CLK then applied again in order to wake up the circuit. Here its crucial that the SM remains high until at least one clock period before it wakes up, this has to be assured by design. This is due to the fact that the SM bit is sampled at the negative CLK edge.

During the next 18 CLK cycles the preample has to be applied, i.e 24 pulses on the DATA pin.

At t=13.6 usec the circuit indicates that the circuit exits the Sleep Mode. It's not important for the TSTMSEQ when this happens but the SM must go high before the next sleep mode iteration.

At t=19.6 usec (at the glitch of the DREAD pin) 18 CLK cycles has elapsed and the preamble is correct detected. This trigger the TSTMSEQ to go into the read DATA mode and during the next 11 CLK cycles it will clock the SW bits into the delay line of the SwitchCtr block. Again DREAD indicate that the TSTMSEQ expect to read DATA from the DATA PAD of the circuit.

A t=24.0 usec the 11 SW control bits are clocked into the delay line at the SW1-SW11 pins are turned on or off according to the previous 11 bits on the DATA pin. Please see the figure below where some of the SW pins are plotted.

Figure 16:
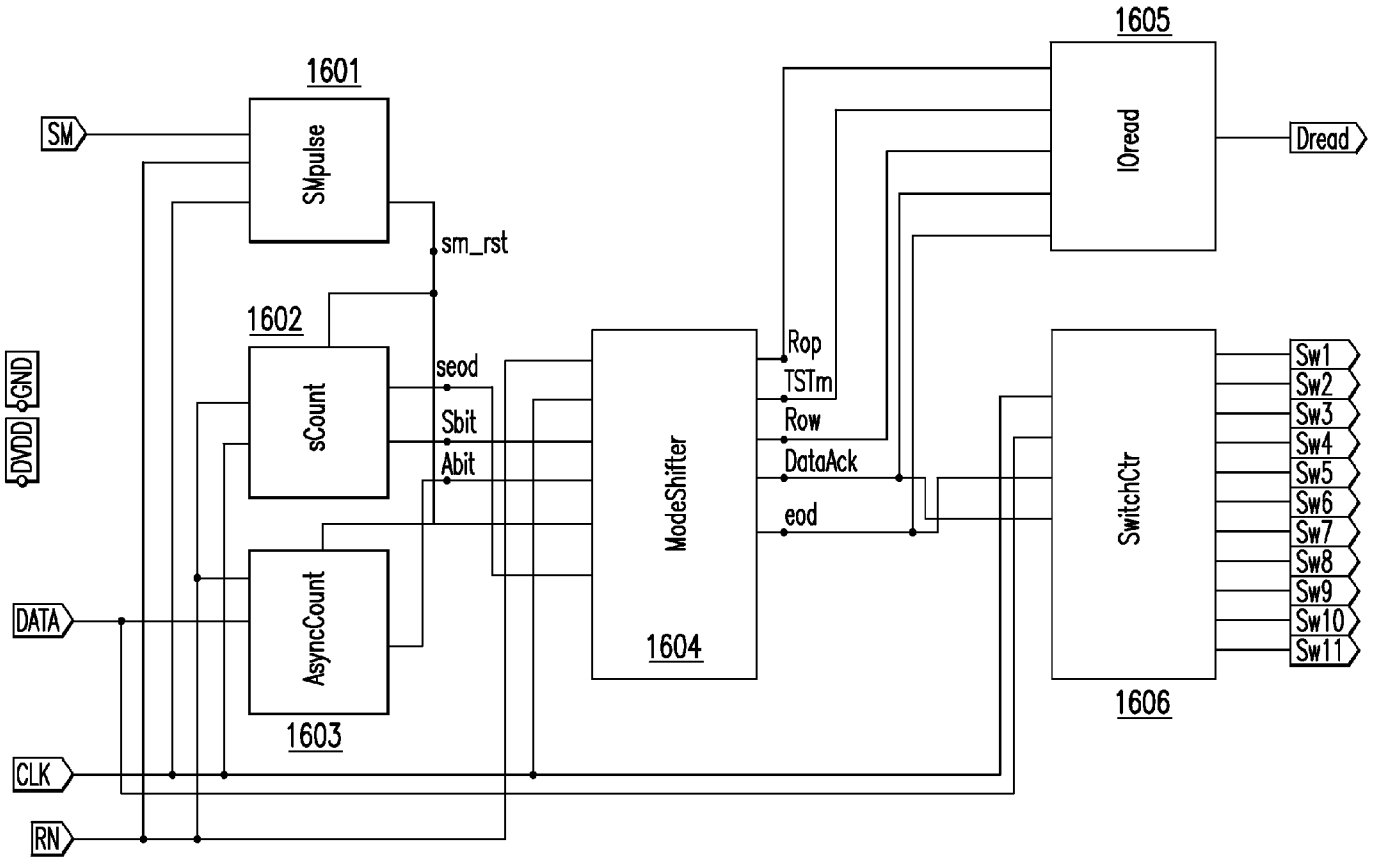
FIG. 16 shows a detailed mode controller.

FIG. 16 shows a detailed mode controller. The TSTMSEQ consist of 6 blocks which will be explained in the following text.

AsyncCount, 1603:

The Asynchronous Counter counts the number of events on the DATA input. The counter is incremented each time a rising edge occur on the DATA input. This means that reflections on the DATA wiring from testequibment (i.e. the A300EV) to the microphone is NOT allowed and these should be damped and some kind of schmitt triggered device must be applied on the DATA PAD terminal.

The output bit "Abit" is set to '1' when the value of the counter is 24 (decimal) otherwise '0'.

The counter has a gated input clock and will stop counting when reaching 31 (decimal).

Further the counter is (MUST) reset, via the RN pin, each time the power is applied to the A300 circuit. The counter is also reset, via the 'sm_rst' node, when the A300 circuits wake up from sleep mode.

Scount, 1602:

The synchronous Counter counts the number of clocks; the count value is updated at the negative edge transaction of the CLK.

The 'sbit ' equal '1' when the count value equals 15 (decimal) otherwise '0', the 'sbit' is used to set the 'TSTm' bit/node if the preamble/start sequence is correct received. The 'seod' equal '1' when all the 11 switch settings is clocked into the flip-flop delay line (setting of SW1-SW11 pins)

Further the counter is (MUST) reset, via the RN pin, each time the power is applied to the A300 circuit. The counter is also reset, via the 'sm_rst' node, when the A300 circuits wake up from sleep mode.

SMpulse, 1601:

The sleep mode pulse block generates the 'sm_rst' signal. The input signal to the SMpulse is the SM pin which again indicates if the circuit is in sleep mode or not. When the SM input pin is '1' the circuit is regarded to be in sleep mode.

The SMpulse block, sample the SM input pin at the falling edge of the CLK and if the SM pin has changed state it generates one clock wide reset signal ('sm_rst').

In order for the SMpulse block to function correctly, it is important that the SM pin holds the signal at least one clock period after the clock is turned on.

ModeShifter, 1604:

The Modeshifter is the heart/brain of the TSTMSEQ block it use all the input signal from the counters and SMpulse reset generator to control the state of the TSTMSEQ block by setting the output signals from the block, which is explained in the following.

The 'Rop' is a short of "read on power up" and this signal equals '1' in the 16 clock period after the RN signals has been abandoned. During this period the preamble/start sequence has to be applied in order to allow the circuits to enter a test mode. If the preamble is detected after power up, the TSTMSEQ sets the 'TSTm' equal '1', and this indicates that the circuit is allowed to enter the test mode after waking up from sleep mode.

The 'TSTm' signals equal '1' when the preamble are detected and 16 clock periods has elapsed after the Power On Reset has abandoned the RN pin. If this signal not equals '1' then it would not be possible for the circuit to enter test mode and all the SW1-SW11 pin will remain inactive (equal '1').

'Row' is a short of "read on waking up', this signal equals '1' in the 16+2 clock periods after the CLK is applied to the circuit in order to wake up the circuits. A side effect is that this signal is also high during the "read on power up" state (indicated by the "Rop" signal), this is not an error. During this period the preamble has to be applied to the DATA PAD in order for the TSTMSEQ to accept the control switch bits. The control switch bits will be read after the 18'th negative CLK transition, if the preamble is correct, currently 11 control bits are accepted.

'DataAck' signal is set to '1' if the preamble after a sleepmode wake up is accepted. The DataAck remains high until the next sleepmode cycles. When the DataAck is '1' the TSTMSEQ accept to receive 11 switch controls bits during the next 11 clock cycles. It stay low ('0') if the preamble not is accepted.

'eod' signal is set to '1' when the last data switch bit are read, i.e. when 11 clock cycle has elapsed, if the preamble not is accepted then the 'eod' signals stay low ('0').

Thus the DigMicCom protocol can be summarized by the below steps:

Master (an External Circuit Communicating to or with the Microphone)

0. Send preamble when powering up (optional)
1. Remove clock
2. Turn on clock (1+2=bring to listen mode)
3. Send preamble on DATA (only if not silence on DATA—two mics)
4. Send program instructions
5. Wait for acknowledge (option)

Slave (the Microphone)

0. Listen for preamble after power-up
1. Listen for missing clock
2. Listen for re-established clock
3. Listen for preamble
4. Listen for program instructions
5. Send acknowledge (option)

Figure 17:
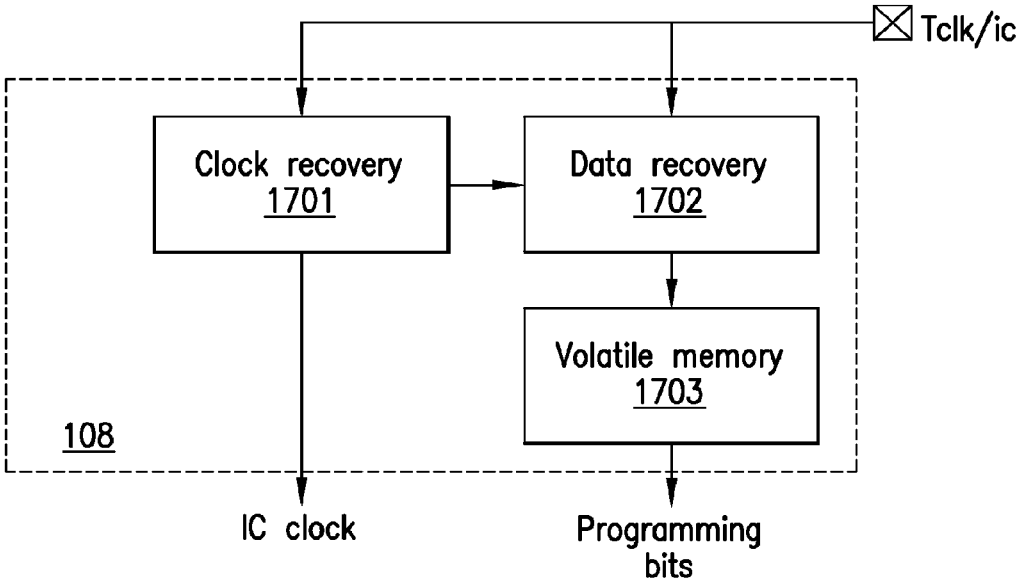
FIG. 17 shows a mode detector 108 configured to retrieve a programming signal which is frequency multiplexed with a clock signal.

FIG. 17 shows a mode detector configured to retrieve a programming signal which is frequency multiplexed with a clock signal. The clock signal and the programming signal is input from an external circuit (not shown).

The mode detector 108 is coupled to receive the clock signal via a terminal Tclk/ic of the integrated circuit. The clock signal is supplied to a clock recovery circuit which is configured to recover the clock signal especially in time intervals when the clock signal is influenced by the programming signal, that is, when the programming signal is transmitted. The clock recovery circuit 1701 can be embodied in different ways as it is known to a person skilled in the art e.g. by means of a Phase-Locked-Loop (PLL). The programming signal can be transmitted according to the Sony/Philips Digital Interface (SPDIF) format which specifies a communications protocol for transmission of a digital signal via a clock signal. The specification is intended for audio signals, but here SPDIF serves as an exemplary principle of transferring the programming signal or a portion thereof.

The clock recovery circuit outputs a recovered clock signal which is supplied to the signal conditioner 103 and/or other blocks of the integrated circuit. The recovered clock signal is also output to a data recovery circuit 1702 which recovers the digital signal (the programming signal) transmitted with the clock signal.

The recovered digital signal is stored in a volatile memory 1703 wherefrom programming bits is read out to the mode changer 107 or other blocks of the integrated circuit. Thus the programming bits are input to a mode changer 107.

The shown configuration is especially suitable for dynamical programming of the microphone.

A configuration for OTP or static programming can be embodied by replacing the volatile memory with a non-volatile memory and couple the non-volatile memory to a high voltage OTP signal which can be provided by an external circuit or on the die by means of a voltage pump.

In a preferred embodiment, the microphone is programmed by one-time-programming, OTP. OTP can be implemented in different ways, but embodiments using 'poly fuses' or 'zener zapping' are examples of embodiments of providing OTP. OTP is a post-fabrication programming method which enables fine-tuning of reference voltages and frequencies or other parameters e.g. a parameter determining whether a microphone is configured as a 'left microphone' or a 'right microphone' for use in a stereo microphone configuration. There are many approaches for such trimming counting metal fuses, poly fuses, Zener zapping, EPROM and E2PROM, among others.

In an embodiment, an OTP signal is provided on a separate pin which is coupled to an OTP mode changer 107. The OTP mode changer 107 has a configuration similar to the mode changer 107 shown above, but instead of dynamically controllable switches it is configured with non-volatile memory e.g. in the form of Zener diodes or fuses which are statically burned or not burned by the OTP programming signal. The diodes or fuses can be arranged in a PROM array coupled to an address circuit which addresses an individual diode or fuse during programming.

In another embodiment, the shown mode detector 108 or mode controller is configured to address the non-volatile memory and a high voltage programming signal is provided via separate terminal. Alternatively, a high voltage signal is provided on the integrated circuit, by means of a voltage pump, and this high voltage signal is controlled by controlling an input signal to the voltage pump or the voltage pump. Thereby, a separate OTP terminal can be avoided. Moreover, alternatively the high voltage signal is provided via a power supply terminal while non-OTP blocks of the IC are decoupled from the power supply terminal in order to protect these blocks from the high voltage.

In a preferred embodiment, the microphone or the integrated circuit thereof is post-manufactured by a method of:

- measuring a performance value of the microphone e.g. gain/sensitivity; comparing the measured performance value with a desired value or desired range of values; and
- providing a programming signal programming the microphone or integrated circuit to achieve a performance which is closer to the desired value or within the desired range or approximately at the desired value.

Thereby it is possible to compensate for variations (originating from compete control of the manufacture processes) between different microphones or integrated circuits.

Figure 18:
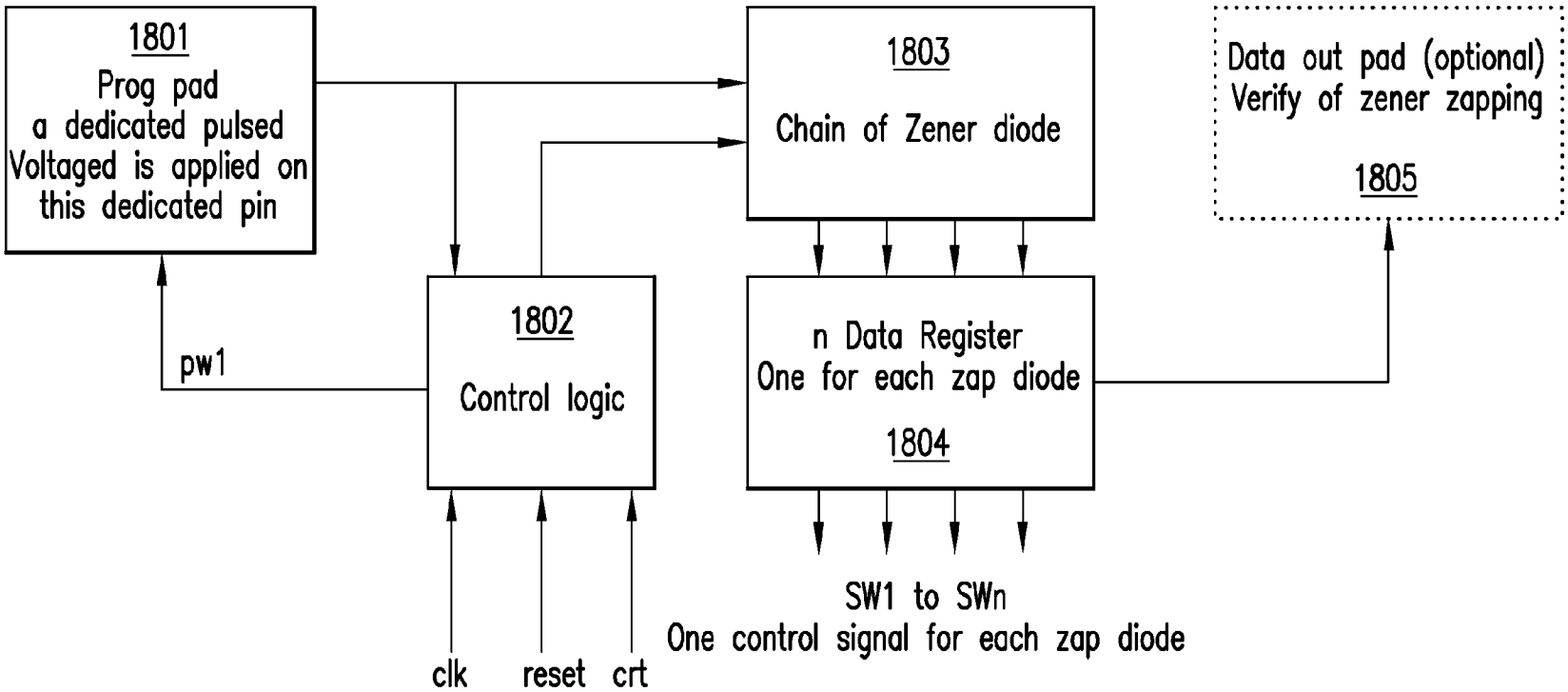
FIG. 18 shows a semiconductor die with an OTP system.

FIG. 18 shows a semiconductor die with an OTP system. An example of an OTP system that could be implemented in a microphone, with digital as well as analogue output is shown. The OTP system shown has four outputs, SW1, SW2, SW3 and SWn (n=4 in this example). These four outputs can be used to control for example a gain setting in a microphone. The "control logic" control 1802: The burning/zapping of the zener diodes in the "chain of zener diode" 1803 subsystem, reading of the zener diode state after powering up the system and optionally sending a verify/ack or the programmed/zapped bits to the output pad 1805 after the diodes has been zapped.

The programming/zapping of the "chain of Zener diodes" 1803 is performed by applying an high voltage pulsing on the Prog pad, this signal has to be synchronized to the clk/crt signals in order to zap the correct diodes. The current flowing in this Prog Pad can be rather high, tens of milliamps, therefore it is important to assure a good and solid gnd connection on the die. The rst signal on the control logic is normally controlled by a Power on Reset signal supplied elsewhere in the system, the rst signal assure that the SW1-SWn signals reflects the current zener zapped diodes state after power up.

Prog pad 1801 is a buffered DC programming input, usually a high current is flowing through this pin or a high voltage level is present at the pin during programming. Normally, the pin is dedicated to this high power programming.

The control logic 1802 controls the burning process and read/write of zener zapped diode and the data registers 1804.

Pw1 is a pulse width control signal for zener diodes. Ctr is an internal control signal to the burn process. 'Data out pad' is an optional pad and can be used to verify the programming of the system.

Figure 19:
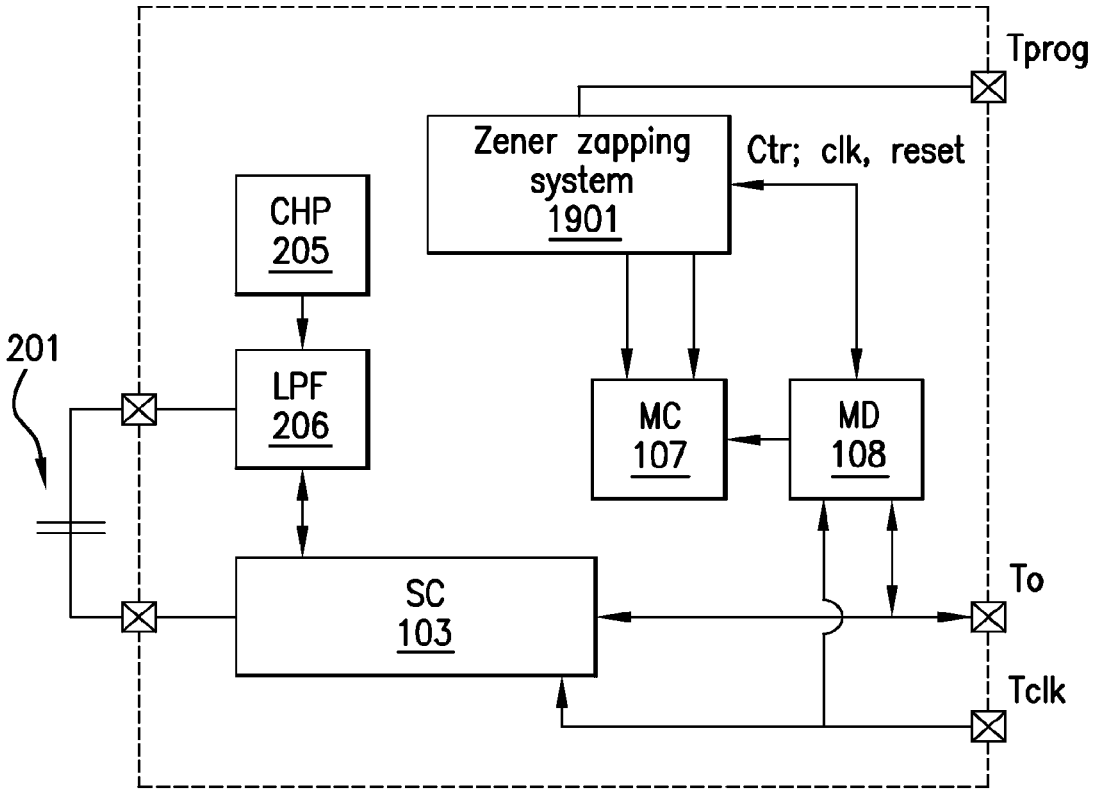
FIG. 19 shows a semiconductor die with an OTP system and a digital output signal.

FIG. 19 shows a semiconductor die with an OTP system and a digital output signal. An example of how the zener zapping system in FIG. 20 can be integrated into a microphone with digital output is shown. In this example a Tprog pad has been added, the tprog pad is used to apply the zapping signal to the "zener zapping System". In order to verify and program the Zener state, the programming bits are send to the microphone via DigiMicCom, please note other possibilities exist. The mode changer 107/detector controls the actually programming od the zener diodes and DigiMicCom sends back and acknowledge bit (or bits) to the external part (the master) to indicate a successful zapping.

Especially during manufacturing of microphones it is very feasible to have incorporated an OTP system in order to decrease the variation in microphone sensitivity. During the testing of the microphones the default sensitivity is measured and difference from the target sensitivity is calculated. The difference is then compensated via the OTP option.

Generally, the listen signal, the preamble signal and the program word signal is denoted a programming signal.

In general it should be noted that the programming signal can be transmitted as a time or frequency multiplexed signal along with the clock signal, a power supply signal, an analogue output signal, a digital output signal or another signal input or output to or from the integrated circuit. Further, the programming signal can be provided as a single signal via a separate terminal.

Still further, it should be noted that portions of the programming signal can be transmitted via the same terminal or the portions can be transmitted via different terminals. For instance, a portion of the programming signal selecting a program mode (a listen signal), can be transmitted along via the clock signal terminal (Tclk/ic), whereas a portion comprising a preamble and a programming word (or parameter value or programming instruction) can be transmitted via a terminal providing the microphone signal.

Although, the description of the digital embodiments is based on a sigma-delta modulator, it should be noted that other types of analogue-to-digital converters can be used.

Generally, a capsule or housing includes shock mounts, acoustic isolators, protective covers and electronic circuitry in addition to the basic transducer.

A housing is a common designation for capsules, cartridges and packages. The designation 'capsule' or 'cartridge' is commonly used when conventional mechanical transducers are referred to e.g. electret microphones. The designation 'package' is commonly used when Micro Electrical Mechanical Systems (MEMS) transducers are referred to. However, there may very well be exceptions to this.

A capacitive transducer can be a microphone (for converting a sound signal to an electrical signal) or a piezo electric element (for converting a physical acceleration of the element to an electrical signal i.e. an accelerometer) or the like.

A semiconductor die can also be denoted an integrated circuit chip. A signal conditioner performs any type of signal conditioning comprising analogue and/or digital signal conditioning.

The invention claimed is:

1. A semiconductor die with an integrated electronic circuit, for mounting in a microphone capsule of a capacitor microphone, the integrated electronic circuit comprising:

a signal conditioner including a first circuit and a second circuit, the second circuit connected to the first circuit, the first circuit configured to receive an input signal at an input node from a capacitive transducer via a first terminal of the semiconductor die and to provide an output signal at an output terminal of the microphone capsule via a second terminal of the semiconductor die; and a mode detector coupled to at least one of a clock signal input or a power input of the semiconductor die, the mode detector configured to select a mode of the signal conditioner by engaging or disengaging the second circuit by a mode select signal.

2. The semiconductor die of claim 1, wherein the mode detector is coupled to the clock signal input to detect into which one of a plurality of predefined frequency ranges the clock signal falls and selects the mode of the signal conditioner based on the detected frequency range.

3. The semiconductor die of claim 1, wherein the signal conditioner includes an amplifier to receive the input signal and a sigma-delta analog-to-digital converter to provide a digital output signal at the second terminal of the semiconductor die.

4. The semiconductor die of claim 3, wherein the digital output signal is read out synchronously to a clock signal provided by an external circuit through the clock signal input.

5. The semiconductor die of claim 1, wherein the signal conditioner is configured to operate in:

a normal operation mode, with a nominal power consumption, for a nominal frequency of the clock signal, and at least one relaxed performance mode, with reduced power consumption relative to the nominal power consumption, for a reduced frequency of the clock signal.

6. The semiconductor die of claim 5, wherein the at least one relaxed performance mode includes a sleep mode where signal processing of the signal conditioner is substantially shut off.

7. The semiconductor die of claim 5, wherein the mode detector is configured to select the normal operation mode if the frequency of the clock signal is above about 2 MHz.

8. The semiconductor die of claim 5, wherein a reduced level of signal processing performance of the signal conditioner is maintained in the at least one relaxed performance mode.

9. The semiconductor die of claim 5, wherein the at least one relaxed performance mode of the signal conditioner includes reduced biasing levels for an amplifier and a sigma-delta analog-to-digital converter of the signal conditioner.

10. The semiconductor die of claim 1, wherein the second circuit includes a first current source that is configured and interconnected with the first circuit, which comprises a second current source, to provide a first current consumption of the integrated electronic circuit when the second circuit is disengaged and to provide a second current consumption, different from the first, when the second circuit is engaged.

11. The semiconductor die of claim 1, wherein the second circuit is configured and interconnected with the first circuit to provide a first signal transfer function, from the input node to an output of the signal conditioner, when the second circuit is disengaged, and to provide a second signal transfer function, different from the first signal transfer function, when the second circuit is engaged.

12. The semiconductor die of claim 1, wherein the integrated electronic circuit further comprises a charge pump with a cascade of charge pump stages, wherein the second circuit includes a portion of the cascade of charge pump stages and engages or disengages the portion so as to control an output voltage from the charge pump.

13. The semiconductor die of claim 1, wherein the second circuit is interconnected with the first circuit so as to be separate from the input node.

14. A capacitor microphone capsule, comprising:

the semiconductor die of claim 1;

a sound passage opening; and the capacitive transducer coupled to the integrated electronic circuit via the first terminal of the semiconductor die.

* * * * *